US011325397B2

(12) United States Patent
Shinsawatsu

(10) Patent No.: US 11,325,397 B2
(45) Date of Patent: May 10, 2022

(54) RECORDING APPARATUS AND CONTROL METHOD

(71) Applicant: CANON KABUSHIKI KAISHA, Tokyo (JP)

(72) Inventor: Yuta Shinsawatsu, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 86 days.

(21) Appl. No.: 16/835,961

(22) Filed: Mar. 31, 2020

(65) Prior Publication Data

US 2020/0316959 A1 Oct. 8, 2020

(30) Foreign Application Priority Data

Apr. 5, 2019 (JP) ..... JP2019-072547

(51) Int. Cl.
*B41J 2/21* (2006.01)

(52) U.S. Cl.
CPC ..... *B41J 2/2103* (2013.01)

(58) Field of Classification Search
CPC .. B41J 2/2103; B41J 2/17546; B41J 2/17543; B41J 2/1752; B41J 2/1753; B41J 2/01; B41J 29/393; B41J 2029/3937; B41J 29/387; B41J 29/46; B41J 2/21; G06F 3/1279
USPC ..... 347/15
See application file for complete search history.

(56) References Cited

U.S. PATENT DOCUMENTS

| | | | | |
|---|---|---|---|---|
| 6,164,740 | A | 12/2000 | Hirai et al. | |
| 2003/0081062 | A1* | 5/2003 | Kim | B41J 2/2103 347/43 |
| 2004/0239711 | A1* | 12/2004 | Koehler | B41J 2/17546 347/19 |
| 2004/0239712 | A1* | 12/2004 | Liao | B41J 2/17546 347/19 |
| 2007/0229582 | A1* | 10/2007 | Yano | B41J 2/1752 347/29 |
| 2008/0007580 | A1 | 1/2008 | Shinada et al. | |
| 2013/0050308 | A1 | 2/2013 | Asauchi | |

FOREIGN PATENT DOCUMENTS

| | | | |
|---|---|---|---|
| CN | 101071284 | A | 11/2007 |
| CN | 101081567 | A | 12/2007 |
| CN | 101204873 | A | 6/2008 |
| CN | 102950904 | A | 3/2013 |
| CN | 106255599 | A | 12/2016 |
| EP | 2611616 | A1 | 7/2013 |
| JP | 2017-185722 | A | 10/2017 |
| JP | 6234117 | B2 | 11/2017 |
| JP | 2017205895 | A | 11/2017 |

* cited by examiner

*Primary Examiner* — Kristal Feggins
*Assistant Examiner* — Alexander D Shenderov
(74) *Attorney, Agent, or Firm* — Canon U.S.A., Inc. I.P. Division

(57) ABSTRACT

A recording apparatus includes an attachment portion not having a storage unit for storing a recording material used for print processing performed by the recording apparatus, and a second control unit configured to operate the recording apparatus in a second print mode in a case where the attachment portion is in a second attachment state in which a second attachment member for protecting a connection terminal is attached to the attachment portion.

19 Claims, 15 Drawing Sheets

RECORDING APPARATUS AND CONTROL METHOD

BACKGROUND OF THE INVENTION

Field of the Invention

The present invention relates to a recording apparatus and a control method.

Description of the Related Art

A recording apparatus that includes an attachment portion to which an attachment member capable of storing a recording material such as ink is detachably attached, is known.

Japanese Patent Application Laid-Open No. 2017-185722 discusses an ink jet printer to which an ink jet head can be attached and detached.

In a state where no attachment member is attached to an attachment portion, connection terminals at the attachment portion for connecting with an attachment member are exposed. This may cause a problem that impurities adhere to the connection terminal. For this reason, when no attachment member capable of storing a recording material is attached to the attachment portion, an attachment member for protecting the connection terminal can be attached to the attachment portion. More specifically, the attachment portion has three different states: a state where an attachment member capable of storing a recording material is attached, a state where an attachment member for protecting the connection terminal is attached, and a state where no attachment member is attached.

Japanese Patent Application Laid-Open No. 2017-185722 does not discuss a state where the attachment member for protecting the connection terminal is attached to the attachment portion and thus does not consider control in a state where the attachment member for protecting the connection terminal is attached to the attachment portion.

The present invention is directed to performing suitable processing based on a state where an attachment member for protecting a connection terminal is attached to an attachment portion.

SUMMARY OF THE INVENTION

According to an aspect of the present invention, a recording apparatus capable of operating in a first print mode, in which first print processing using at least a recording material of a first color and a recording material of a second color can be performed, and a second print mode, in which second print processing using the recording material of the first color and not using the recording material of the second color can be performed, and including an attachment portion to which a first attachment member having a storage unit for storing the recording material of the second color or a second attachment member not having the storage unit is attachable, includes an acquisition unit configured to acquire predetermined information via a predetermined component included in the recording apparatus to acquire information based on a temperature of the first attachment member in a case where the first attachment member is attached to the attachment portion, wherein, in a case where the first attachment member is attached to the attachment portion, the information based on the temperature of the first attachment member is acquired as the predetermined information, a determination unit configured to perform determination processing for determining whether the first attachment member is attached to the attachment portion or the second attachment member is attached to the attachment portion based on the acquired predetermined information, and a control unit configured to operate the recording apparatus in the first print mode in a case where determination unit determines that the first attachment member is attached to the attachment portion, and operate the recording apparatus in the second print mode in a case where determination unit determines that the second attachment member is attached to the attachment portion.

Further features of the present invention will become apparent from the following description of exemplary embodiments with reference to the attached drawings.

BRIEF DESCRIPTION OF THE DRAWINGS

FIG. 9 is a graph illustrating a threshold value for determining which attachment state the attachment portion is in.

DESCRIPTION OF THE EMBODIMENTS

Exemplary embodiments of an ink jet recording apparatus according to the present invention will be described below. The components described in the following exemplary embodiments are illustrative and are not intended to limit the scope of the present invention. The present specification will describe a serial ink jet recording apparatus for performing recording by reciprocating a recording head for discharging ink onto a recording medium that is intermittently conveyed, in a direction intersecting with the conveyance direction of the recording medium. However, the present invention is not limited to serial ink jet recording apparatuses, and is also applicable to line ink jet recording apparatuses for performing continuous printing by using a long print head. The present invention is also applicable not only to ink jet recording apparatuses but also to electrophotographic recording apparatuses and recording apparatuses of other types. Terms used in the present specification are as follows. The term "recording material" includes ink and toner. The term "ink" is used to collectively refer to liquids such as recording liquids. The term "recording" includes not only recording to a planar medium but also recording to a three-dimensional object. The term "recording medium" refers to media to which liquid is discharged and collectively refers to recording media such as paper, cloths, plastic films, metal plates, glass, ceramics, wood, and leather. Recording media include not only cut sheets but also rolled continuous sheets.

Figure 1:
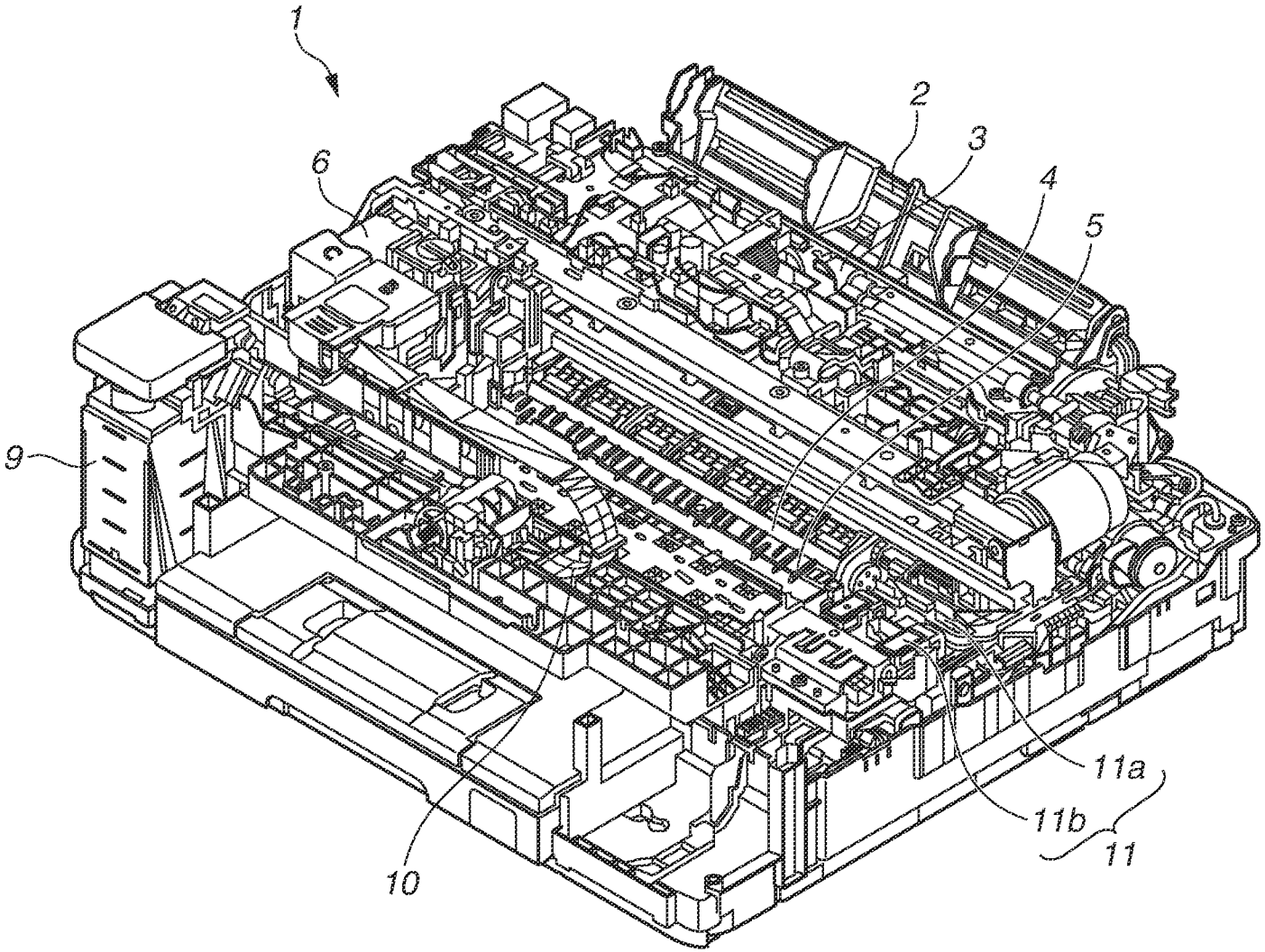
FIG. 1 is a perspective view illustrating an internal configuration of a recording apparatus.

FIG. 1 is a perspective view illustrating an internal configuration of an ink jet recording apparatus (hereinafter referred to as a recording apparatus) 1 according to a first exemplary embodiment. In the recording apparatus 1, each sheet material (not illustrated) as a recording medium stacked on a paper feed tray 2 is conveyed to a conveyance unit 4 by a feed roller 3. The sheet material conveyed to the conveyance unit 4 is further conveyed to the print position while being supported by a platen 5. When the sheet material is conveyed to the print position, a carriage 6 discharges ink from recording heads 7 (not illustrated in FIG. 1) included in the carriage 6 while moving along a rail supporting the carriage 6, to record (print) an image on the sheet material. The sheet material with an image recorded thereon is discharged to a discharge tray (not illustrated) through a discharge unit (not illustrated). The recording apparatus 1 includes an ink tank 9 and a tube 10 as a unit for supplying ink to the recording heads 7. In the recording apparatus 1, the recording heads 7 include a recording head 7*a* for discharging black ink and a recording head 7*b* for discharging non-black ink (cyan, magenta, and yellow ink). The tube 10 connects the ink tank 9 and the recording head 7*a* to supply ink stored in the ink tank 9 to the recording head 7*a*. The recording head 7*a* includes an ink chamber (not illustrated) as a storage unit for storing ink to be supplied from the ink tank 9 during print processing. The recording head 7*b* also includes an ink chamber (not illustrated) as a storage unit for storing ink to be supplied from an ink cartridge (not illustrated) included in the recording head 7*b* during print processing. The recording apparatus 1 discharges ink stored in each storage unit to perform print processing. More specifically, according to the present exemplary embodiment, the ink tank 9 stores black ink. The recording apparatus 1 further includes a recovery unit 11 as a maintenance member for maintaining the discharge performance of the recording heads 7. The recovery unit 11 includes a wiper 11*a* for wiping out the surface of the ink discharge port of the recording heads 7 and a cap 11*b* for covering the surface of the ink discharge port.

Figure 2:
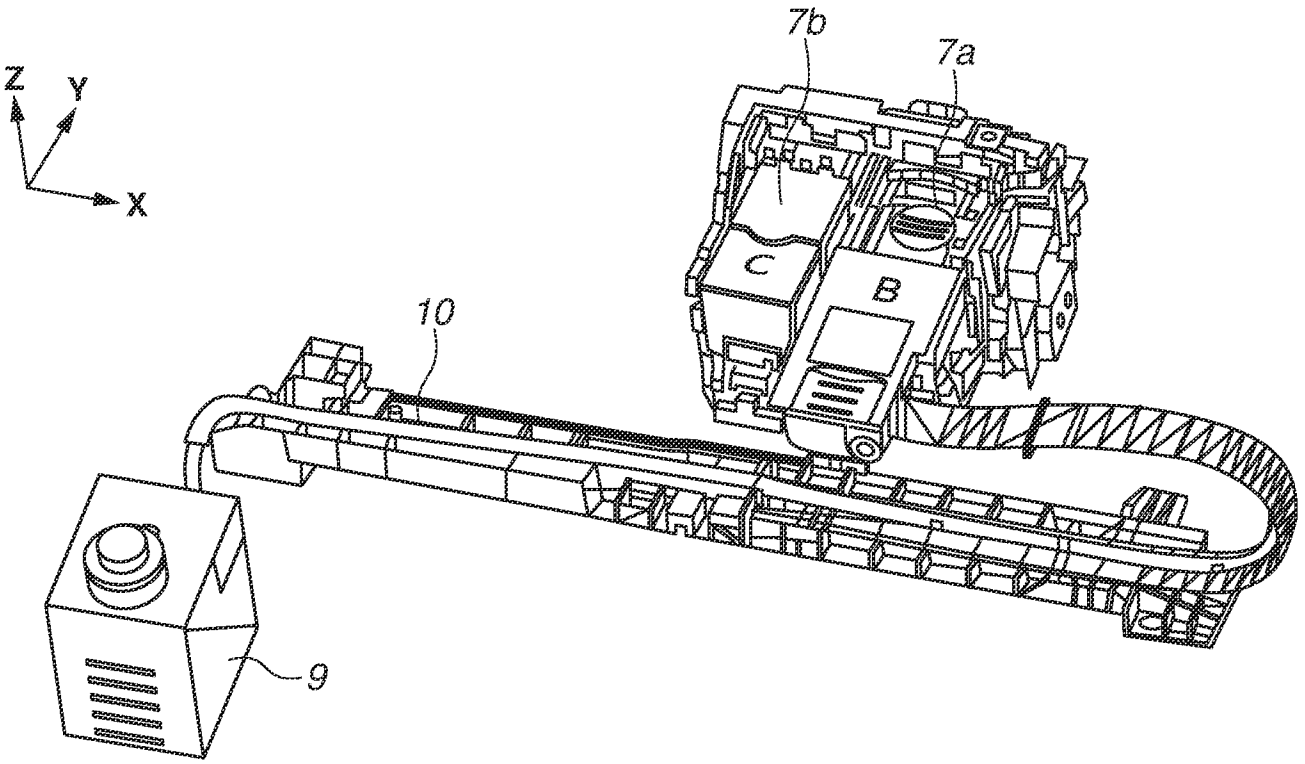
FIG. 2 is a perspective view illustrating an ink supply unit.

FIG. 2 is a perspective view illustrating an ink supply unit included in the recording apparatus 1. The ink supply unit includes the ink tank 9, the recording heads 7, and the tube 10. As described above, according to the present exemplary embodiment, the recording apparatus 1 includes the recording heads 7*a* and 7*b* as the recording heads 7. Each of the recording heads 7*a* and 7*b* can be attached to and detached from the recording apparatus 1.

As described above, the tube 10 connects the recording head 7*a* and the ink tank 9 to supply black ink stored in the ink tank 9 to the ink chamber included in the recording head 7*a*. The recording head 7*a* discharges ink supplied to the ink chamber. When the ink stored in the ink tank 9 runs out, the user supplies ink to the ink tank 9 to resolve the ink-out status. The recording head 7*a* is replaced with a new one by the user if the discharge performance degrades. When the recording head 7*a* is removed from the recording apparatus 1, the tube 10 is also removed from the recording head 7*a*. When the recording head 7*a* is attached to the recording apparatus 1 again, the recording head 7*a* and the tube 10 are reconnected with each other.

The recording head 7*b* includes an ink cartridge storing non-black ink (color ink). According to the present exemplary embodiment, color ink is prestored in the ink cartridge of the recording head 7*b* without being supplied from the ink tank 9 outside the ink cartridge. Therefore, if the color ink stored in the ink cartridge of the recording head 7*b* runs out, the recording apparatus 1 notifies the user of an ink-out error, and the user replaces the recording head 7*b* with a new one.

Figure 3A:
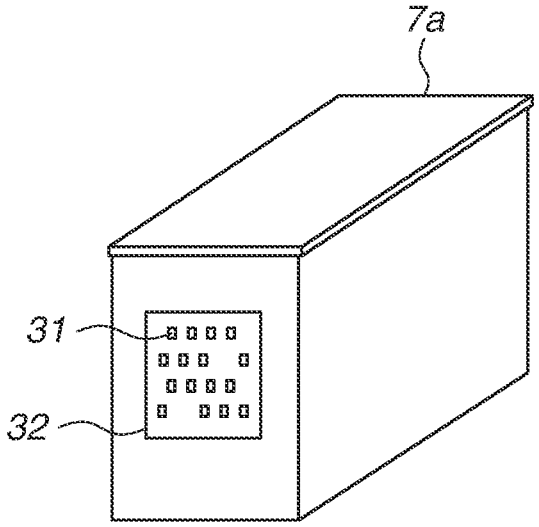
FIGS. 3A and 3B are schematic views illustrating recording heads.
Figure 3B:
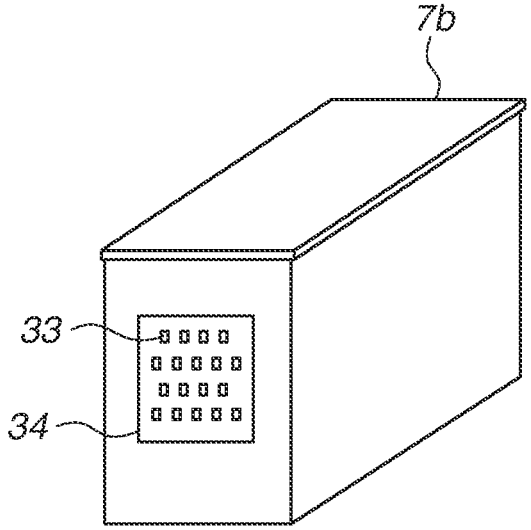

FIG. 3A is a schematic view illustrating the recording head 7*a*, and FIG. 3B is a schematic view illustrating the recording head 7*b*. Each recording head includes an ink chamber for storing ink, a discharge port for discharging the ink in the ink chamber, and a drive circuit for thermally controlling the ink discharge (none of them is illustrated). The recording head 7*a* is provided with a plurality of metal pads 31 to be connected to the head connector included in the carriage, on a Flexible Printed Circuit (FPC) substrate 32. The recording head 7*a* is supplied with power and print data via the connection between the head connector and the pads 31. The recording head 7*b* is provided with a plurality of metal pads 33 to be connected to the head connector included in the carriage, on an FPC substrate 34. The recording head 7*b* is supplied with power and print data via the connection between the head connector and the pads 33. Since the recording head 7*b* discharges ink of a plurality of colors, the capacity of the print data to be transmitted from the main body of the recording apparatus 1 to the recording head 7*b* is larger than that when supplying unicolor ink. Therefore, the number of pads 33 included in the recording head 7*b* is larger than the number of pads 31 included in the recording head 7*a*.

Figure 4:
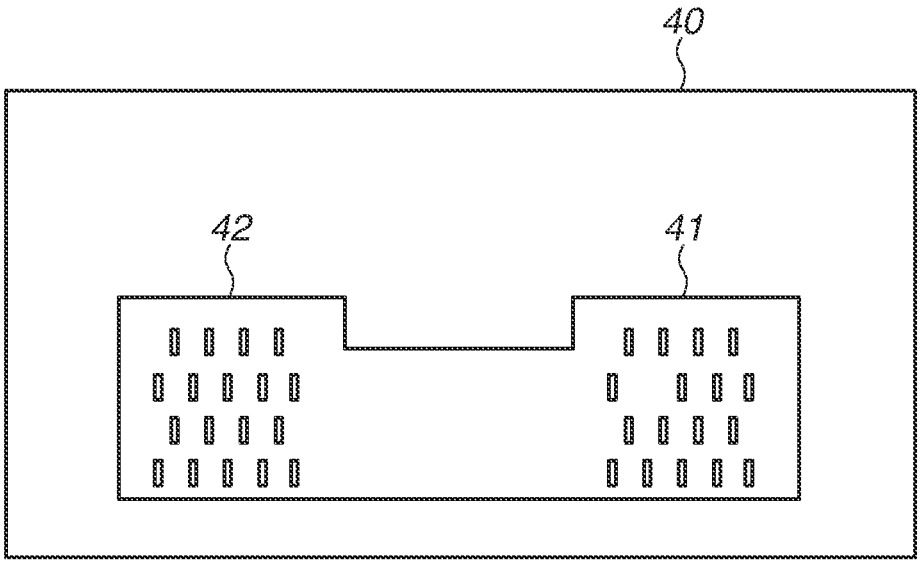
FIG. 4 illustrates a carriage substrate unit.

FIG. 4 illustrates a carriage substrate unit built in the carriage included in the recording apparatus 1. A head connector 41 on a carriage substrate 40 is a metal connection terminal for connecting to the pads 31 included in the recording head 7*a*. A head connector 42 on the carriage substrate 40 is a metal connection terminal for connecting to the pads 33 included in the recording head 7*b*.

Figure 12:
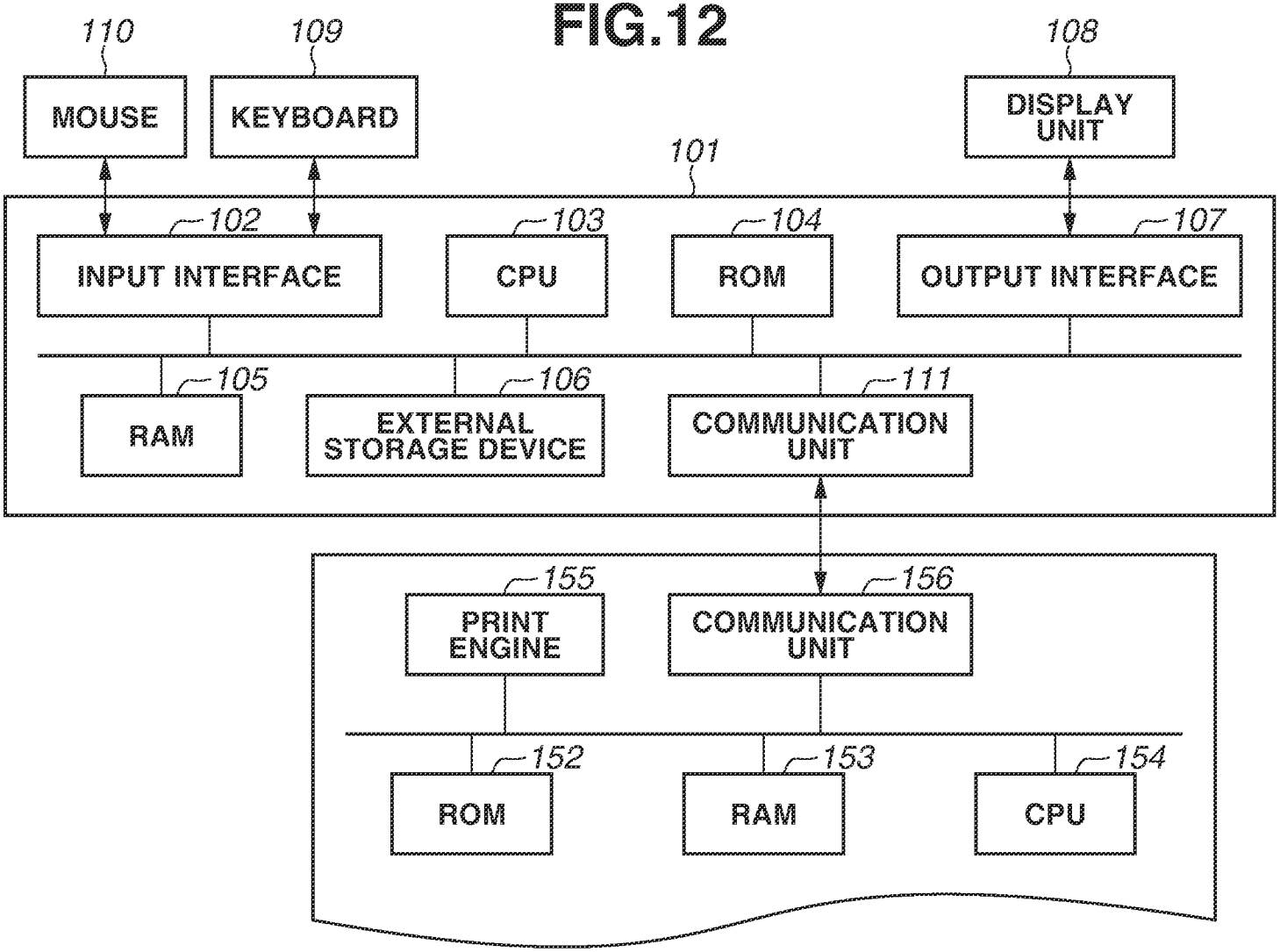
FIG. 12 is a block diagram illustrating configurations of an information processing apparatus and the recording apparatus.

Configurations of an information processing apparatus 101 according to the present exemplary embodiment and the recording apparatus 1 capable of communicating with the information processing apparatus 101 according to the present exemplary embodiment will be described with reference to the block diagram illustrated in FIG. 12. Although the present exemplary embodiment will be described centering on the following example configuration, functions are not particularly limited to the configurations illustrated in FIG. 12.

The information processing apparatus 101 generates and transmits a print job for instructing the recording apparatus 1 to perform printing. Although, in the present exemplary embodiment, a personal computer (PC) is described as an example of the information processing apparatus 101, it is not limited thereto. As the information processing apparatus 101, a portable terminal, smart phone, tablet terminal, personal digital assistant (PDA), digital camera, and other apparatuses are applicable.

The information processing apparatus 101 includes an input interface 102, a central processing unit (CPU) 103, a read only memory (ROM) 104, a random access memory (RAM) 105, an external storage device 106, an output interface 107, a display unit 108, and a communication unit 111. The computer of the information processing apparatus 101 is formed of the CPU 103, the ROM 104, and the RAM 105.

The input interface 102 receives data input and operation instructions from the user when a mouse 110 and a keyboard 109 are operated.

The CPU 103 serves as a system control unit for controlling the entire information processing apparatus 101.

The ROM 104 stores fixed data including control programs to be executed by the CPU 103, data table, and a built-in operating system (OS) program. According to the present exemplary embodiment, each control program stored in the ROM 104 performs software execution control including scheduling, task switching, and interrupt processing under the control of the built-in OS stored in the ROM 104.

The RAM 105 includes a static random access memory (SRAM) requiring a backup power source. Since the data in the RAM 105 is retained by a primary battery for data backup (not illustrated), program control variables and other important data can be stored without volatilization. Memory areas for storing setting information for the information processing apparatus 101 and management data for the information processing apparatus 101 are also provided in the RAM 105. The RAM 105 is also used as a main memory and a work memory for the CPU 103.

The external storage device 106 stores printing information generation programs for generating printing information that can be interpreted by the recording apparatus 1. The external storage device 106 stores various programs including information transmission and reception control programs for transmitting data to and receiving data from the recording apparatus 1 connected via the communication unit 111. The external storage device 106 also stores various types of information used by these programs.

The output interface 107 controls the display unit 108 to display data and notify the user of the status of the information processing apparatus 101.

The display unit 108 includes light emitting diodes (LEDs) or a liquid crystal display (LCD) to display data and notify the user of the status of the information processing apparatus 101. An operation unit including numerical value input keys, mode setting keys, a determination key, a cancel key, and a power key may be provided on the display unit 108. Inputs from the user may be accepted through the display unit 108.

The communication unit 111 is configured to connect with the recording apparatus 1 and perform data communication. For example, the communication unit 111 is connectable to an access point (not illustrated) in the recording apparatus 1. When the communication unit 111 connects to the access point in the recording apparatus 1, the information processing apparatus 101 and the recording apparatus 1 can communicate with each other. The communication unit 111 may directly communicate with the recording apparatus 1 through wireless communication, or communicate with the recording apparatus 1 via an external apparatus existing outside the information processing apparatus 101 and the recording apparatus 1. Examples of external apparatuses include an external access point existing outside the information processing apparatus 101 and outside the recording apparatus 1, and an apparatus capable of relaying communication, other than access points. Examples of wireless communication methods include Wireless Fidelity (Wi-Fi®). Examples of access points include a wireless local area network (LAN) router.

The information processing apparatus 101 is configured to wirelessly connect with an apparatus such as the recording apparatus 1 in a short distance to perform data communication. The information processing apparatus 101 may include a short distance wireless communication unit for performing communication by using a communication method different from that of the communication unit 111. Examples of communication methods of the short distance wireless communication unit include Near Field Communication (NFC), Bluetooth (registered trademark) Classic, Bluetooth Low Energy (BLE), and Wi-Fi Aware. The information processing apparatus 101 may include a wired communication unit for performing wired communication with the recording apparatus 1 through Universal Serial Bus (USB) or wired LAN.

The recording apparatus 1 includes a ROM 152, a RAM 153, a CPU 154, a print engine 155, and a communication unit 156. The computer of the recording apparatus 1 is formed of the ROM 152, the RAM 153, and the CPU 154.

The communication unit 156 has an access point for connecting with an apparatus such as the information processing apparatus 101, as the access point in the recording apparatus 1. The access point is connectable to the communication unit 111 of the information processing apparatus 101. When the communication unit 156 enables the access point, the recording apparatus 1 can operate as an access point. The communication unit 156 may directly communicate with the information processing apparatus 101 through wireless communication, or communicate with the information processing apparatus 101 via an external access point. Examples of communication methods include Wi-Fi®. The communication unit 156 may include a hardware component functioning as an access point or operate as an access point by software for making the communication unit 156 function as an access point.

The recording apparatus 1 is configured to wirelessly connect with an apparatus such as the information processing apparatus 101 in a short distance to perform data communication. The recording apparatus 1 may include a short distance wireless communication unit for performing communication by using a communication method different from that of the communication unit 156. Examples of communication methods of the short distance wireless communication unit include NFC, Bluetooth® Classic, BLE, and Wi-Fi Aware. The recording apparatus 1 may include a wired communication unit for performing wired communication with the information processing apparatus 101 through a USB or wired LAN.

The RAM 153 includes a SRAM requiring a backup power source. Since the data in the RAM 153 can be retained by a primary battery for data backup (not illustrated), program control variables and other important data can be stored without volatilization. Memory areas for storing setting information for the recording apparatus 1 and management data for the recording apparatus 1 are also provided in the RAM 153. The RAM 153 is also used as a main memory and a work memory for the CPU 154. The RAM 153 serves as a reception buffer for temporarily storing printing information received from the information processing apparatus 101 and stores various information.

The ROM 152 stores fixed data including control programs to be executed by the CPU 154, a data table, and a built-in OS program. According to the present exemplary embodiment, each control program stored in the ROM 152 performs software execution control including scheduling, task switching, and interrupt processing under the control of the built-in OS stored in the ROM 152.

The CPU 154 serves as a system control unit for controlling the entire recording apparatus 1.

The print engine 155 applies a recording material such as ink to a recording medium such as paper based on information stored in the RAM 153 and a print job received from the information processing apparatus 101, to form an image on the recording medium. Then, the print engine 155 outputs a printing result. More specifically, the print engine 155 transmits print data generated based on the received print job to the recording heads 7, and causes the recording heads 7 to discharge ink based on the print data.

The recording apparatus 1 may be attached with memories such as an external hard disk drive (HDD) and secure digital (SD) card as optional devices, and information to be stored in the recording apparatus 1 may be stored in these memories.

According to the present exemplary embodiment, the recording apparatus 1 can operate in two different modes of a color print mode and a monochromatic print mode. In the color print mode, the recording apparatus 1 can perform both color printing using ink of a plurality of colors and monochrome printing using only black ink. In the monochromatic print mode, the recording apparatus 1 can perform only monochrome printing. When operating the recording apparatus 1 in the color print mode, the user needs to attach both the recording heads 7*a* and 7*b* to the recording apparatus 1. On the other hand, when operating the recording apparatus 1 in the monochromatic print mode, the user needs to attach the recording head 7*a* to the recording apparatus 1 but does not need to attach the recording head 7*b* to the recording apparatus 1.

Basically, the recording apparatus 1 according to the present exemplary embodiment is handled as a monochromatic printer capable of performing only monochrome printing. The recording apparatus 1 is handled as a color printer for color printing in a case where the user separately purchases the recording head 7*b* and attaches it to the recording apparatus 1. Therefore, at the time of arrival of the recording apparatus 1, the recording head 7*a* is attached to the recording apparatus 1 but the recording head 7*b* is not. The carriage substrate 40 and the head connector 42 are portions of the carriage to be attached to the recording head 7*b* (hereinafter collectively referred to as an attachment portion). When no attachment member is attached to the attachment portion, the head connector 42 will be exposed. When the head connector 42 is exposed, there arises a problem that impurities (such as ink mist caused by ink discharge) adheres to the head connector 42, possibly degrading the head connector 42.

According to the present exemplary embodiment, to solve this problem, a contact protector 50 for protecting the head connector 42 can be attached to the attachment portion of the recording apparatus 1. Therefore, at the time of arrival of the recording apparatus 1, the recording head 7*a* and the contact protector 50 is attached to the recording apparatus 1.

Figure 5:
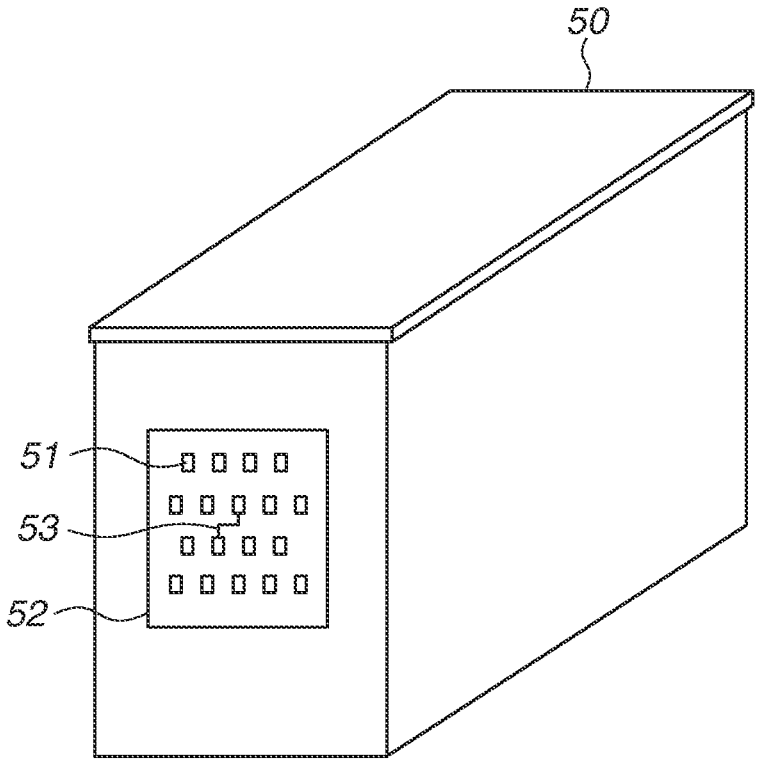
FIG. 5 is a schematic view illustrating a contact protector.

FIG. 5 is a schematic view illustrating the contact protector 50. The contact protector 50 is used to protect the head connector 42 and is not used for print processing. Therefore, unlike the recording heads 7, the contact protector 50 includes none of the ink chamber, discharge port, and drive circuit for thermally controlling ink discharge. On the contact protector 50, metal pads 51 to be connected with the head connector 42 of the carriage are formed on an FPC substrate 52. The pads 51 of the contact protector 50 are formed on the FPC substrate 52 in a similar arrangement to the pads 33 in the recording head 7*b*. When the contact protector 50 is attached to the attachment portion, impurities can be prevented from adhering to the head connector 42. In addition, the head connector 42 can be prevented from being degraded. The contact protector 50 includes a circuit 53 for short-circuiting predetermined two of the plurality of the pads 33. The role of the circuit 53 will be described below.

More specifically, according to the present exemplary embodiment, there are three different states of the attachment portion (hereinafter referred to as attachment states): a first attachment state where the recording head 7*b* is attached to the attachment portion, a second attachment state where the contact protector 50 is attached to the attachment portion, and a third attachment state where no attachment member is attached to the attachment portion.

Operations to be performed by the recording apparatus 1 depend upon the attachment state of the attachment portion. For example, according to the present exemplary embodiment described above, the attachment portion needs to be in one of the first and the second attachment states to perform printing by the recording apparatus 1 while preventing the degradation of the head connector 42. Therefore, when the attachment portion is in the third attachment state, the present exemplary embodiment notifies the user of an error. For example, the present exemplary embodiment operates the recording apparatus 1 in the color print mode when the attachment portion is in the first attachment state, and operates the recording apparatus 1 in the monochromatic print mode when the attachment portion is in the second attachment state. This enables the recording apparatus 1 to perform processing suitable for the attachment state of the attachment portion.

To perform processing suitable for the attachment state of the attachment portion, the recording apparatus 1 according to the present exemplary embodiment performs state determination processing for determining which of the three attachment states the attachment portion is in, and performs processing according to the result of the state determination processing. This enables the recording apparatus 1 to automatically determine its own print mode in a suitable manner.

The state determination processing according to the present exemplary embodiment will be described in detail.

Figure 6:
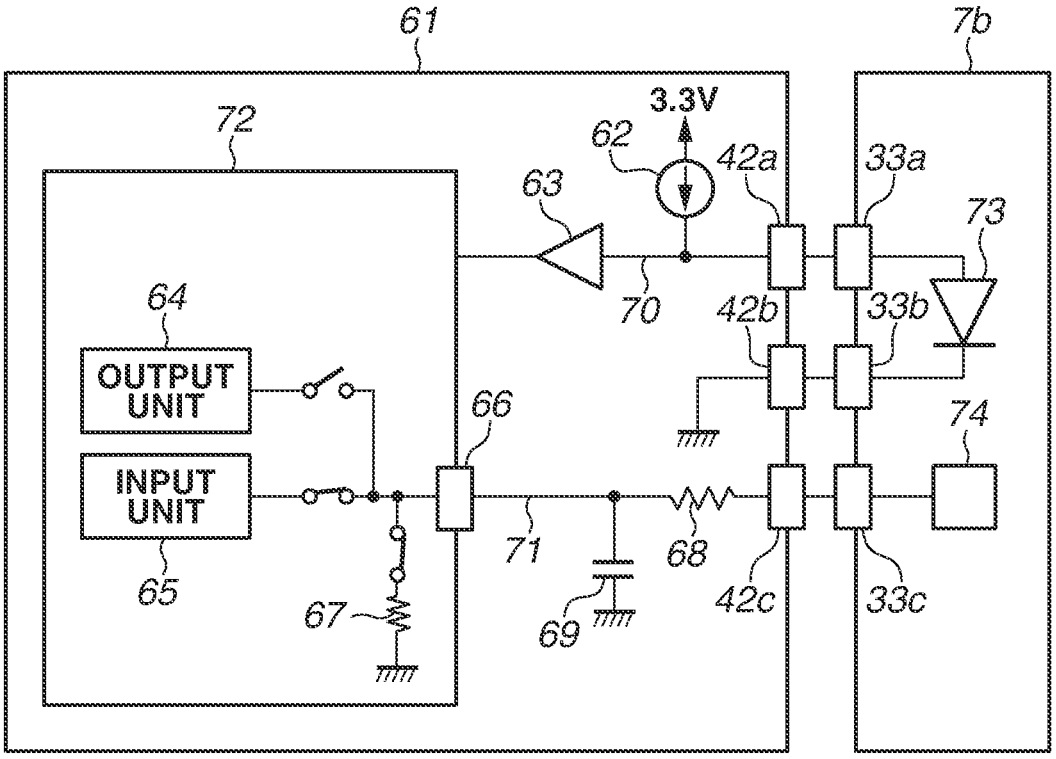
FIG. 6 illustrates a circuit configuration when an attachment portion is in a first attachment state.

FIG. 6 illustrates the circuit configuration when the attachment portion is in the first attachment state. A circuit 61 disposed on the main body side (on the outer side of the recording heads) of the recording apparatus 1 includes a circuit 70 for obtaining the output from a diode temperature sensor 73 and a circuit 71 for inputting print data to the recording head 7*b*. The circuit 70 connects with the recording head 7*b* via a head connector 42*a* and a pad 33*a*. The circuit 71 connects with the recording head 7*b* via a head connector 42*c* and a pad 33*c*.

Circuit components 64 to 69 and 71 are configured to transmit print data to the recording head 7*b*. The print data is transmitted to a logic block 74 in the recording head 7*b* via a filter formed of a resistor 68 and a capacitor 69. The recording head 7*b* discharges ink based on the print data received in this way. A General Purpose Input/Output (GPIO) terminal 66 is a terminal for connecting an Application Specific Integrated Circuit (ASIC) 72 and a circuit 71, and operates in the input or output state. The input state refers to a state where an input unit 65 and the GPIO terminal 66 are connected with each other and where print data and other signals are not supplied to the recording head 7*b*. The output state refers to a state where an output unit 64 and the GPIO terminal 66 are connected with each other and where print data and other signals can be supplied to the recording head 7*b*. To prevent unnecessary signals from being output to the recording head 7*b*, the recording apparatus 1 basically operates the GPIO terminal 66 in the input state other than during execution of print processing. The output unit 64 is connected to the ground. The ASIC 72 includes a pull-down resistor 67 which is connected to the GPIO terminal 66 in a state where the GPIO terminal 66 is set in the input state. In other words, FIG. 6 illustrates the circuit configuration when the GPIO terminal 66 is in the input state.

When the attachment portion is in the first attachment state, a constant current source 62 in the circuit 61 supplies current to a diode temperature sensor 73 in a circuit in the recording head 7*b*. Thus, the diode temperature sensor 73 outputs a voltage Vf based on the temperature of the recording head 7*b*.

Since the voltage Vf has a minute value, the diode temperature sensor 73 outputs the voltage Vf to an amplifier 63 to amplify the voltage Vf. Thus, the amplifier 63 outputs a voltage Vfa having the amplified value of the voltage Vf. According to the present exemplary embodiment, the amplifier 63 has characteristics GAIN=$\alpha$ and offset=$\beta$ and therefore provides a specific value $\alpha Vf+\beta$ of the voltage Vfa. The amplifier 63 outputs the voltage Vfa to the converter included in the ASIC 72. The ASIC 72 performs analog-to-digital (A/D) conversion on the voltage Vfa by using the converter and outputs a digital value based on the voltage Vf. According to the present exemplary embodiment, the 10-bit converter performs the AD conversion with a reference voltage Vref (=3.3 V) and therefore the specific digital value becomes $1024(\alpha Vf+\beta)/3.3$. Then, the ASIC 72 outputs the digital value obtained in this way to the CPU 154. Thus, when the attachment portion is in the first attachment state, the CPU 154 acquires the digital value based on the voltage Vf acquired from the diode temperature sensor 73 via the circuit 70. Then, the CPU 154 identifies that the attachment portion is in the first attachment state based on the acquisition of a digital value within a specific range. In this case, since the temperature of the recording head 7*b* is close to the room temperature, the CPU 154 identifies that the attachment portion is in the first attachment state based on the acquisition of the digital value corresponding to the temperature of the recording head 7*b* close to the room temperature. The state determination processing performed using the digital value based on the voltage value acquired via the circuit 70 in a state where the GPIO terminal 66 is set in the input state is hereinafter referred to as first determination processing.

Figure 7A:
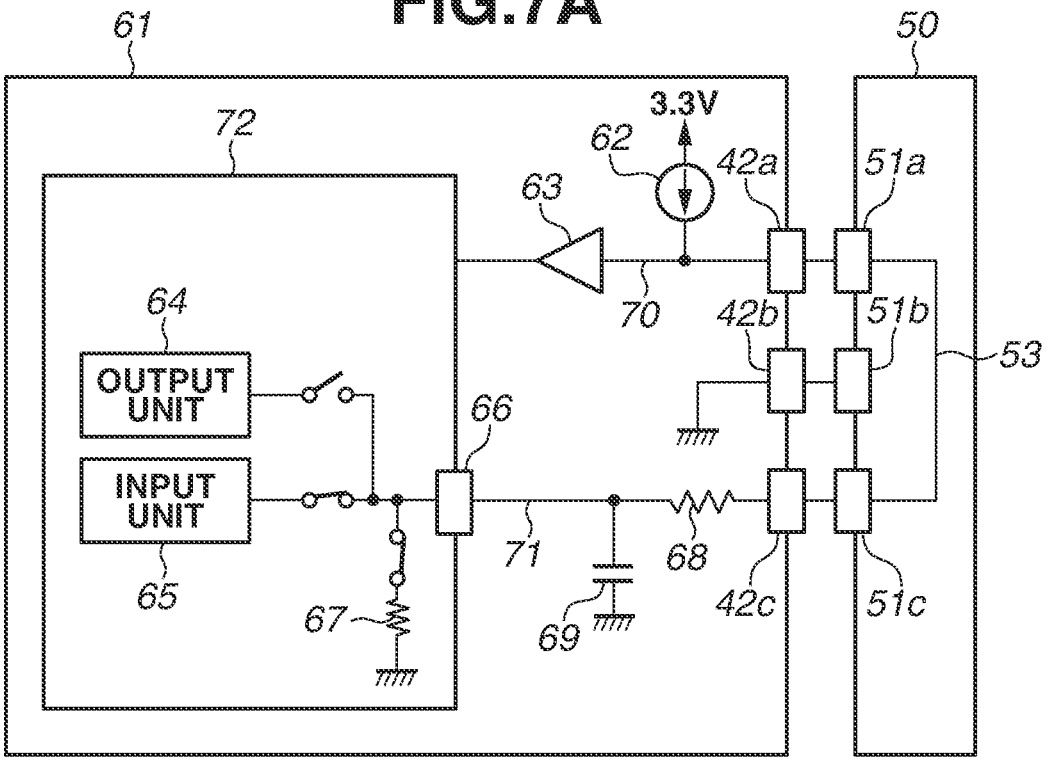
FIGS. 7A and 7B illustrate circuit configurations when the attachment portion is in a second attachment state.

FIG. 7A illustrates the circuit configuration when the GPIO terminal 66 is in the input state, and the attachment portion is in the second attachment state. The circuit 53 included in the contact protector 50 short-circuits the input circuit 70 for obtaining the output from the diode temperature sensor 73 and the circuit 71 for inputting print data to the recording head 7*b*.

When the constant current source 62 starts supplying current while the attachment portion is in the second attachment state, power is supplied to the circuit 71 since the circuits 70 and 71 are short-circuited. At this timing, the input unit 65 is insulated in a state where the GPIO terminal 66 is set in the input state and therefore power is not supplied to the input unit 65 but supplied to the pull-down resistor 67. Since the pull-down resistor 67 has a sufficiently large resistance value, a voltage (power source voltage) 3.3 V to be used by the constant current source 62 to supply a constant current is output to the amplifier 63 via the circuit 70. According to the present exemplary embodiment, since the amplifier 63 outputs 3.3 V as the upper limit voltage, the voltage input to the amplifier 63 is not amplified. As a result, the voltage of 3.3 V is input to the ASIC 72, and the digital value corresponding to 3.3 V is output by the converter. In other words, when the attachment portion is in the second attachment state, the CPU 154 acquires, via the circuit 70, a digital value based on the upper limit voltage (3.3 V) that can be output to the amplifier 63. The 3.3V-based digital value is largely different from the digital value acquired when the attachment portion is in the first attachment state. Therefore, when the 3.3V-based digital value is acquired, the attachment portion is identified to be not in the first attachment state.

As described below, when the attachment portion is in the third attachment state, the 3.3 V-based digital value (or a digital value close to 3.3 V) is also acquired by the CPU 154. Thus, in the first determination processing, when the digital value corresponding to 3.3 V is acquired, the CPU 154 cannot determine whether the attachment portion is in the second attachment state or in the third attachment state. Therefore, according to the present exemplary embodiment, when the digital value corresponding to 3.3 V is acquired in a state where the GPIO terminal 66 is set in the input state, the CPU 154 further performs second determination processing for determining whether the attachment portion is in the second attachment state or in the third attachment state.

Figure 7B:
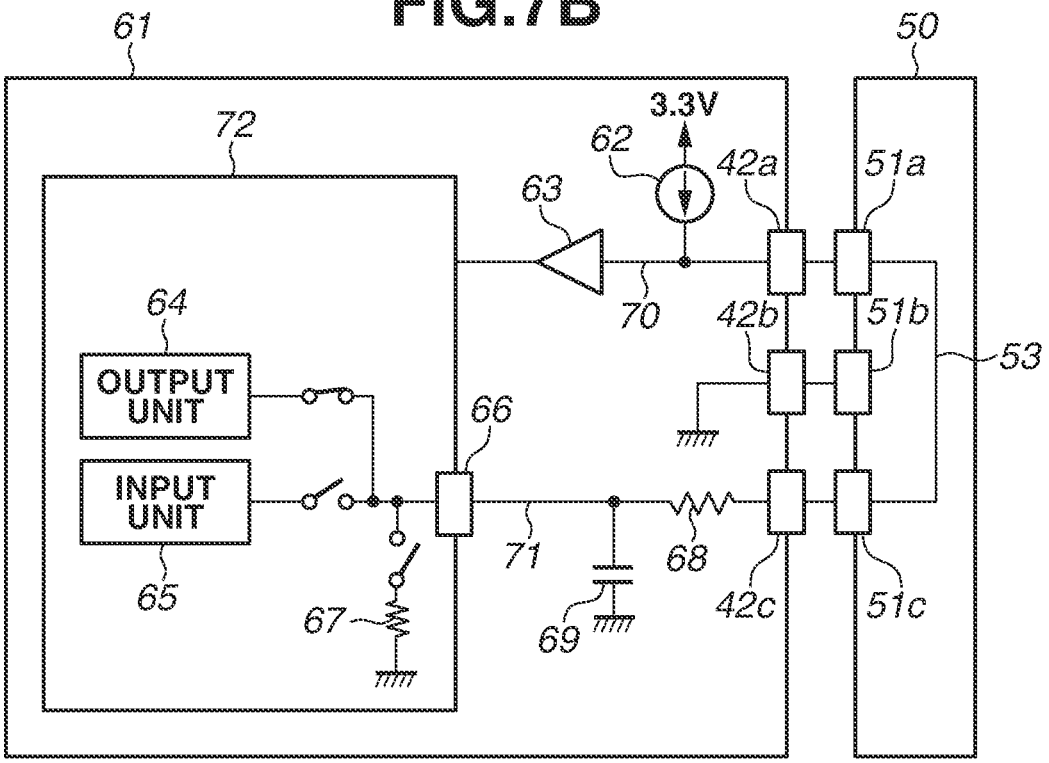

More specifically, by changing the switches in the ASIC 72, the CPU 154 disconnects the pull-down resistor 67 from the GPIO terminal 66 to change the GPIO terminal 66 from the input state to the output state. Thus, the circuit configuration illustrated in FIG. 7B results. Then, in the circuit configuration illustrated in FIG. 7B, the constant current source 62 starts supplying current, and the CPU 154 acquires a digital value. Then, the CPU 154 determines whether the attachment portion is in the second attachment state or in the third attachment state based on the acquired digital value. In other words, the second determination processing is state determination processing using the digital value based on the voltage value acquired via the circuit 70 in a state where the GPIO terminal 66 is set in the output state. In the second determination processing executed when the attachment portion is in the second attachment state, as the output unit 64 is connected to the ground, a voltage of 0 V (or a voltage close to 0 V) will be input to the amplifier 63 and the ASIC 72 via the circuit 70. As a result, the CPU 154 acquires a 0V-based digital value when the attachment portion is in the second attachment state. Therefore, the CPU 154 identifies that the attachment portion is in the second attachment state based on the acquisition of the digital value corresponding to 0 V when the GPIO terminal 66 is set in the output state.

Figure 8A:
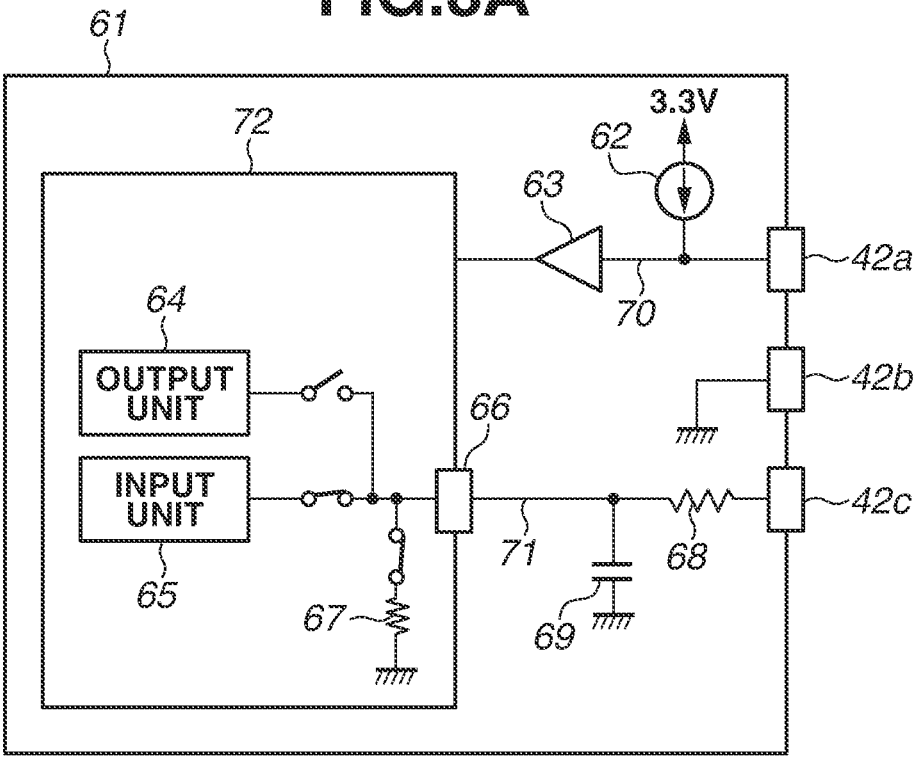
FIGS. 8A and 8B illustrate circuit configurations when the attachment portion is in a third attachment state.

FIG. 8A illustrates the circuit configuration when the GPIO terminal 66 is in the input state, and the attachment portion is in the third attachment state.

When the attachment portion is in the third attachment state, the circuit 70 on the main substrate becomes a high-impedance state since the circuit 70 is not electrically connected with other circuits. In the high-impedance state, no current flows even if the constant current source 62 tries to send current. The voltage of 3.3 V to be used by the constant current source 62 to supply current is output to the amplifier 63 via the circuit 70. As a result, when the attachment portion is in the third attachment state, the digital value corresponding to 3.3 V is acquired by the CPU 154, like the state where the attachment portion is in the second attachment state. Therefore, according to the present exemplary embodiment described above, the CPU 154 performs the second determination processing when the digital value corresponding to 3.3 V is acquired in a state where the GPIO terminal 66 is set in the input state.

Figure 8B:
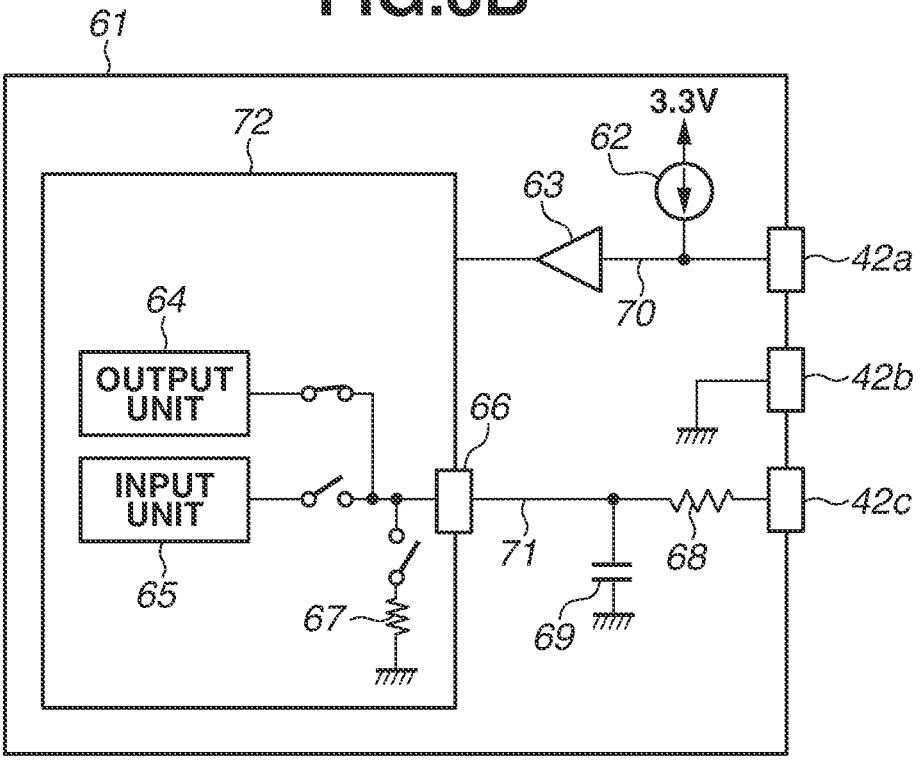

In the second determination processing, the circuit configuration illustrated in FIG. 8B is given by switching the circuit. Even with this circuit configuration (i.e., circuit configuration in which the GPIO terminal 66 is set in the output state), the circuit 70 remains in the high-impedance state. Accordingly, even if the constant current source 62 starts supplying current in this circuit configuration, the CPU 154 acquires, via the circuit 70, the digital value corresponding to the voltage of 3.3 V to be used by the constant current source 62 to supply current, like the first determination processing. Therefore, the CPU 154 identifies that the attachment portion is in the third attachment state based on the acquisition of the digital value corresponding to 3.3 V in a state where the GPIO terminal 66 is set in the output state.

Figure 9:
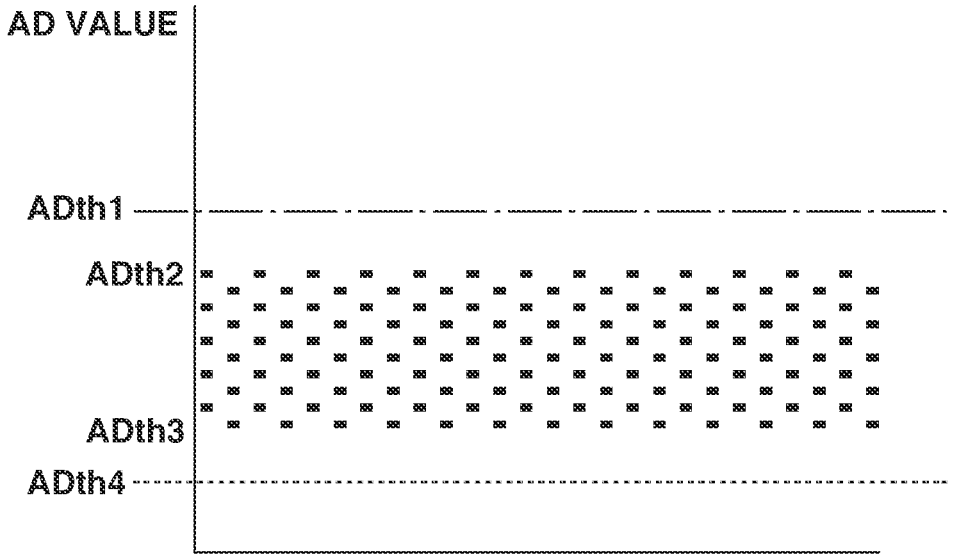

FIG. 9 is a graph illustrating a threshold value for determining which attachment state the attachment portion is in. When the digital value acquired in a state where the GPIO terminal 66 is set in the input state is within a range from a threshold value ADth2 to a threshold value ADth3, the attachment portion is determined to be in the first attachment state. When the digital value is out of the range from the threshold value ADth2 to the threshold value ADth3, the attachment portion is determined to be not in the first attachment state. The range from the threshold value ADth2 to the threshold value ADth3 is set so as to include the digital value corresponding to the temperature (i.e., room temperature) of the normal state of the recording head 7*b*. When the digital value acquired in a state where the GPIO terminal 66 is set in the output state exceeds a threshold value ADth1, the attachment portion is determined to be in the third attachment state. When the digital value acquired in a state where the GPIO terminal 66 is set in the output state is below a threshold value ADth4, the attachment portion is determined to be in the second attachment state. The threshold value ADth1 is set to be smaller than the digital value corresponding to 3.3 V, and the threshold value ADth4 is set to be larger than the digital value corresponding to 0 V.

In this way, the recording apparatus 1 according to the present exemplary embodiment performs the state determination processing by using a value based on the voltage value acquired via the circuit 70 (i.e., the digital value acquired by the CPU 154). The recording apparatus 1 is capable of acquiring the temperature based on the acquired digital value by applying the acquired digital value to a calculation formula based on the temperature characteristics of the diode temperature sensor 73. In this way, when the attachment portion is in the first attachment state, the recording apparatus 1 can acquire the temperature based on the voltage Vf output by the diode temperature sensor 73 to acquire the temperature of the recording head 7*b*. Then, the recording apparatus 1 has a temperature determination function for determining whether the recording head 7*b* maintains suitable temperature during printing, by acquiring the temperature of the recording head 7*b* at the time of the printing in this way. This function makes it possible to identify that ink discharge cannot be exactly controlled, for example, because of an excessive temperature rise or excessive temperature fall of the recording head 7*b* during printing. If such a state is identified, the recording apparatus 1 notifies the user of an error.

Then, according to the present exemplary embodiment, the recording apparatus 1 also performs the state determination processing based on the value acquired via a circuit (circuit 70) for acquiring the output from a sensor (diode temperature sensor 73) for controlling the temperature determination function. This makes it possible to implement the state determination processing without adding special configurations for the state determination processing. The CPU 154 may perform the state determination processing based not on the digital value itself but on the value of the temperature acquired from the digital value, as described above. Thus, the CPU 154 only needs to perform the state determination processing based on the value output from a circuit for acquiring the output value from the diode temperature sensor 73.

Although the CPU 154 performs both determination processing in a state where the GPIO terminal 66 is set in the input state (first determination processing) and determination processing in a state where the GPIO terminal 66 is set in the output state (second determination process), the present invention is not limited thereto. For example, the CPU 154 may not perform the first determination processing and may perform only the second determination processing. In the second determination processing, the digital value corresponding to the room temperature is acquired in the first attachment state, the digital value corresponding to 0 V is acquired in the second attachment state, and the digital value corresponding to 3.3 V is acquired in the third attachment state. Therefore, even in the configuration for performing only the second determination processing, the CPU 154 can determine (identify) which of the first, the second, and the third attachment states the attachment portion is in.

Figure 10:
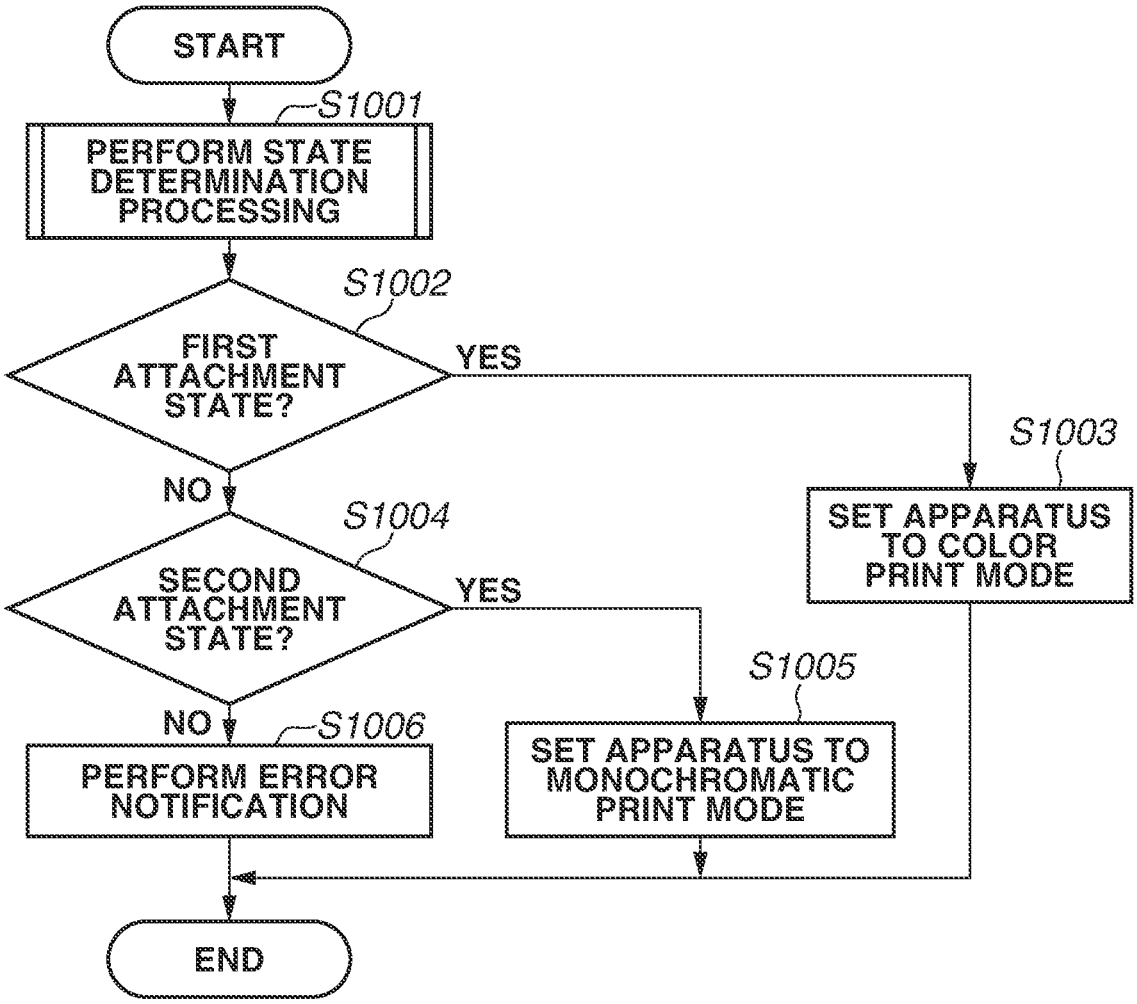
FIG. 10 is a flowchart illustrating state determination processing and processing based on the state determination processing.

FIG. 10 is a flowchart illustrating the state determination processing performed by the recording apparatus 1, and processing based on the result of the state determination processing. For example, the processing indicated by the flowchart is implemented when the CPU 154 loads a program stored in the ROM 152 into the RAM 153 and then executes the program. The processing indicated by the flowchart is started when power of the recording apparatus 1 is turned on or when the recording head attached to the recording apparatus 1 is replaced. The CPU 154 detects whether the recording head attached to the recording apparatus 1 is replaced, for example, by detecting whether the cover for replacing the recording head included in the housing of the recording apparatus 1 is opened or closed. The processing indicated by the flowchart is started in a state where the GPIO terminal 66 is set in the input state.

In step S1001, the CPU 154 performs the state determination processing (described in detail below).

In step S1002, the CPU 154 determines whether the attachment state determined by the state determination processing in step S1001 is the first attachment state. When the attachment state is the first attachment state (YES in step S1002), the processing proceeds to step S1003. On the other hand, when the attachment state is not the first attachment state (NO in step S1002), the processing proceeds to step S1004.

In step S1003, the CPU 154 operates the recording apparatus 1 in the color print mode. More specifically, for example, when operating the recording apparatus 1 in the color print mode, the CPU 154 performs a preparation operation for each of the recording heads 7A and 7B to use both. Thus, the recording apparatus 1 enters a state where both color printing and monochrome printing can be executed. The recording apparatus 1 includes a color print designation portion for issuing an instruction for executing color printing, and a monochromatic print designation portion for issuing an instruction for executing monochrome printing. Then, the recording apparatus 1 performs color printing when the user operates the color print designation portion, and performs monochrome printing when the user operates the monochromatic print designation portion. For example, while the recording apparatus 1 is operating in the color print mode, the CPU 154 enables both the color and the monochromatic print designation portions to enable reception of print instructions from the two designation portions. Each designation portion may be a physical button (not illustrated) included in the recording apparatus 1 or a soft button displayed on a screen by the recording apparatus 1. Printing performed when each designation portion is operated may be printing based on image data acquired by the recording apparatus 1 by scanning a document, or printing based on image data in a memory such as a USB memory and an SD card attached to the recording apparatus 1. When operating the recording apparatus 1 in the color print mode, the CPU 154, for example, transmits information indicating that the recording apparatus 1 operates in the color print mode to the information processing apparatus 101 connecting with the recording apparatus 1. Thus, the information processing apparatus 101 becomes able to transmit both a print job for executing monochrome printing and a print job for executing color printing to the recording apparatus 1. When operating the recording apparatus 1 in the color print mode, the CPU 154 displays, for example, a screen indicating that both the recording heads 7*a* and 7*b* are attached to the recording apparatus 1 and that the recording apparatus 1 operates in the color print mode. Then, the CPU 154 ends the processing of this flowchart.

In step S1004, the CPU 154 determines whether the attachment state that is identified by the state determination processing in step S1001 is the second attachment state that is identified by the state determination processing in step S1001. When the attachment state is the second attachment state (YES in step S1004), the processing proceeds to step S1005. On the other hand, when the attachment state is not the second attachment state (NO in step S1004), the processing proceeds to step S1006.

In step S1005, the CPU 154 operates the recording apparatus 1 in the monochromatic print mode. More specifically, for example, the CPU 154 performs a preparation operation only for the recording head 7*a* to use the recording head 7*a*. Thus, the recording apparatus 1 becomes able to perform monochrome printing although the recording apparatus 1 is unable to perform color printing. For example, while the recording apparatus 1 is operating in the monochromatic print mode, the CPU 154 disables the color print designation portion and enables reception of only print instructions from the monochromatic print designation portion. For example, the CPU 154 transmits information indicating that the recording apparatus 1 operates in the monochromatic print mode to the information processing apparatus 101 connecting with the recording apparatus 1. In this way, the information processing apparatus 101 is unable to transmit a print job for executing color printing to the recording apparatus 1 but is able to transmit a print job for executing monochrome printing to the recording apparatus 1. For example, the CPU 154 displays a screen indicating that the recording head 7*a* is attached to the recording apparatus 1 but the recording head 7*b* is not attached thereto and that the recording apparatus 1 operates in the monochromatic print mode. Then, the CPU 154 ends the processing of this flowchart.

In step S1006, the CPU 154 performs error notification processing for notifying the user of the occurrence of an error in which none of the recording head 7*b* and the contact protector 50 is attached to the attachment portion (hereinafter this error is referred to as an attachment error). More specifically, the CPU 154, for example, displays an error notification screen for notifying the user that an attachment error occurs, on the display unit (not illustrated) included in the recording apparatus 1. For example, the CPU 154 transmits error notification information for notifying the user that an attachment error occurs to the information processing apparatus 101 connecting with the recording apparatus 1. Thus, the information processing apparatus 101 displays an error notification screen on the display unit 108. In this case, the information processing apparatus 101 may perform, for example, notification processing for promoting the user to attach the recording head 7*b* or the contact protector 50 to the attachment portion. In a state where an attachment error occurs, the recording apparatus 1 is unable to perform color printing or monochrome printing. More specifically, while an attachment error occurs, the CPU 154 disables both the color print and the monochromatic print designation portions and controls the recording apparatus 1 to operate in a mode (error mode) in which the recording apparatus 1 can receive no print instructions from both designation portions. For example, the CPU 154 transmits information indicating that the recording apparatus 1 operates in the error mode to the information processing apparatus 101 connecting with the recording apparatus 1. Thus, the information processing apparatus 101 becomes unable to transmit a print job for executing color printing or a print job for executing monochrome printing to the recording apparatus 1. Then, the CPU 154 ends the processing of this flowchart.

Figure 11:
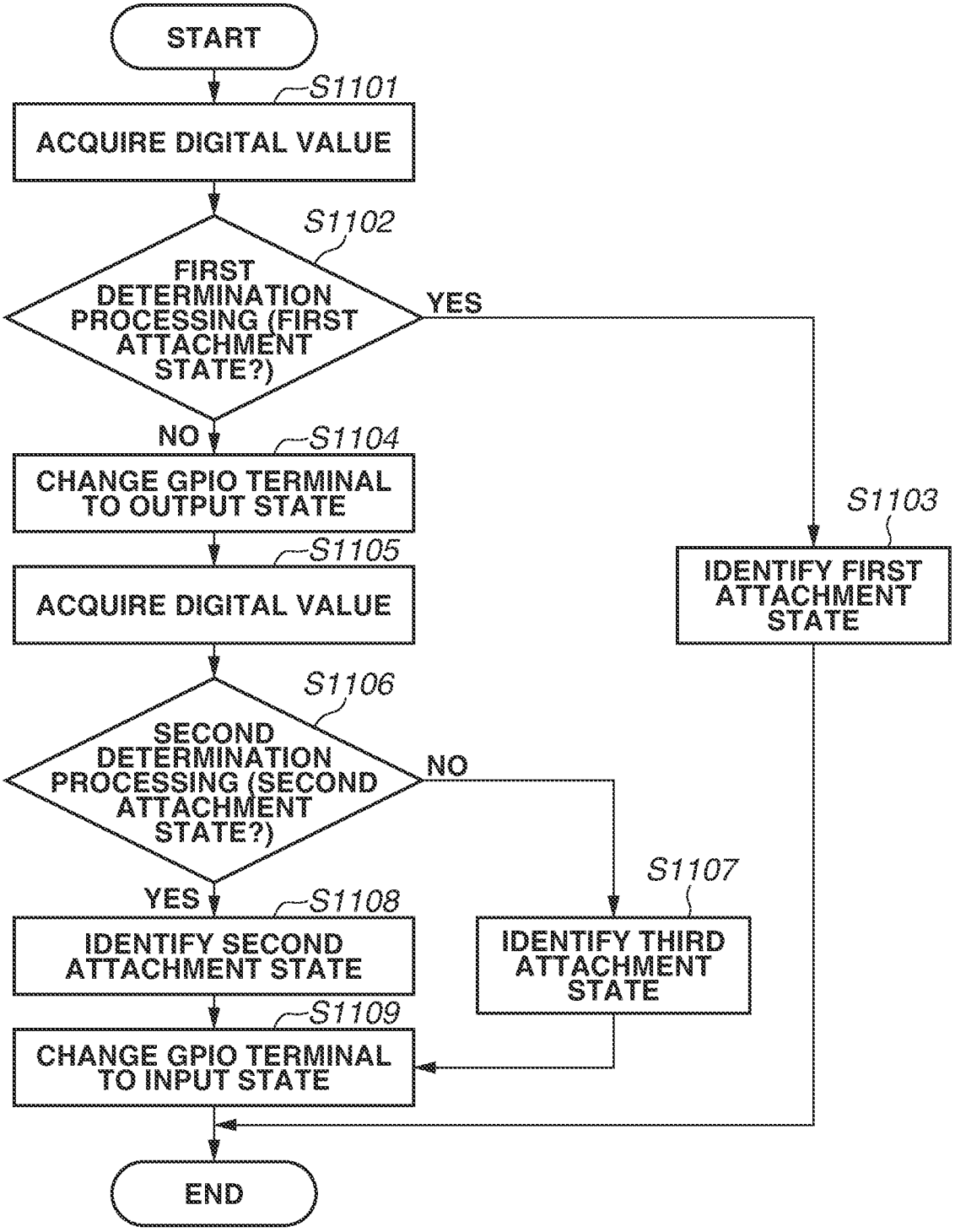
FIG. 11 is flowchart illustrating details of the state determination processing.

FIG. 11 is a flowchart illustrating details of the state determination processing performed in step S1001 by the recording apparatus 1. For example, the processing indicated by the flowchart is implemented when the CPU 154 loads a program stored in the ROM 152 into the RAM 153 and then executes the program.

In step S1101, in a state where the GPIO terminal 66 is set in the input state, the CPU 154 starts supplying current by the constant current source 62 and acquires the digital value corresponding to the output via the circuit 70. The method for acquiring the digital value is as described above.

In step S1102, the CPU 154 performs the first determination processing. More specifically, the CPU 154 determines whether the attachment portion is in the first attachment state based on the digital value acquired in S1101 and the threshold value illustrated in FIG. 9. When the attachment portion is in the first attachment state (YES in step S1102), the processing proceeds to step S1103. On the other hand, when the attachment portion is not in the first attachment state (NO in step S1102), the processing proceeds to S1104.

In step S1103, the CPU 154 identifies that the attachment portion is in the first attachment state. This identification result is referenced in the processing in the flowchart illustrated in FIG. 10, as described above. Then, the CPU 154 ends the processing of this flowchart in FIG. 11, and the processing proceeds to step S1002 in FIG. 10.

In step S1104, the CPU 154 disconnects the pull-down resistor 67 from the GPIO terminal 66 to change the GPIO terminal 66 from the input state to the output state.

In step S1105, the CPU 154 starts supplying current by the constant current source 62 and acquires the digital value corresponding to the output by the circuit 70. The method for acquiring the digital value is as described above.

In step S1106, the CPU 154 performs the second determination processing. More specifically, the CPU 154 determines whether the attachment portion is in the second attachment state (or in the third attachment state) based on the digital value acquired in S1105 and the threshold value illustrated in FIG. 9. When the attachment portion is not in the second attachment state (NO in step S1106), the processing proceeds to step S1107. On the other hand, when the attachment portion is in the second attachment state (YES in step S1106), the processing proceeds to step S1108.

In step S1107, the CPU 154 identifies that the attachment portion is in the third attachment state. This identification result is referenced in the processing in the flowchart illustrated in FIG. 10, as described above. Then, the processing proceeds to step S1109.

In step S1108, the CPU 154 identifies that the attachment portion is in the second attachment state. This identification result is referenced in the processing in the flowchart illustrated in FIG. 10, as described above. Then, the processing proceeds to step S1109.

In step S1109, the CPU 154 re-establishes the connection between the pull-down resistor 67 and the GPIO terminal 66 to change the GPIO terminal 66 from the output state to the input state. Then, the CPU 154 ends the processing of this flowchart and then proceeds to step S1002 in FIG. 10.

The above-described configuration enables the recording apparatus 1 according to the present exemplary embodiment to suitably determine which of the first, the second, and the third attachment states the attachment portion is in, and then perform suitable processing according to the identified attachment state.

A second exemplary embodiment will be described below centering on a configuration in which the recording apparatus 1 performs processing in consideration of not only the attachment state of the attachment portion to which the recording head 7*b* is attached but also the attachment state of the attachment portion to which the recording head 7*a* is attached. Hereinafter, the attachment portion to which the recording head 7*a* is attached is referred to as a first attachment portion, and the attachment portion to which the recording head 7*b* is attached is referred to as a second attachment portion.

As described above in the first exemplary embodiment, not only the recording head 7*b* but also the recording head 7*a* are attachable to and detachable from the recording apparatus 1. However, unlike the second attachment portion, the contact protector 50 is never attached to the first attachment portion. This is because, unlike the recording head 7*b*, the recording head 7*a* is attached to the recording apparatus 1 at the time of arrival thereof and thus the head connector 41 is protected by the recording head 7*a*. Thus, the attachment states of the first attachment portion include the first and the third attachment states but does not include the second attachment state.

Thus, according to the present exemplary embodiment, the CPU 154 determines one of the first, the second, and the third attachment states as the attachment state of the second attachment portion, and determines one of the first and the third attachment states as the attachment state of the first attachment portion. Hereinafter, the state determination processing related to the first attachment portion is referred to as first state determination processing, and the state determination processing related to the second attachment portion is referred to as second state determination processing. The second state determination processing is similar to the state determination processing according to the first exemplary embodiment.

The first state determination processing according to the present exemplary embodiment will be described in detail.

Figure 13A:
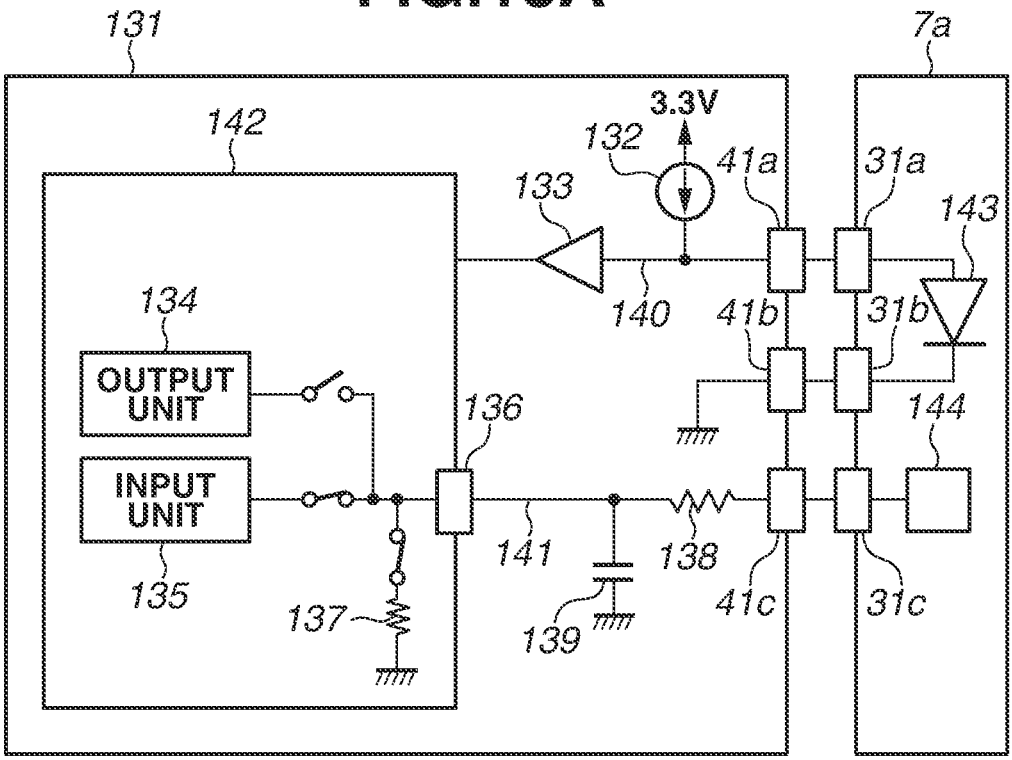
FIGS. 13A and 13B illustrate circuit configurations when a first attachment portion is in the first attachment state.

FIG. 13A illustrates a circuit configuration when the first attachment portion is in the first attachment state.

A circuit 131 on the main substrate disposed on the main body side of the recording apparatus 1 includes a circuit 140 for obtaining the output from a diode temperature sensor 143, and a circuit 141 for inputting print data to the recording head 7*a*. The circuit 140 connects with the recording head 7*a* via a head connector 41*a* and a pad 31*a*. The circuit 141 connects with the recording head 7*a* via a head connector 41*c* and a pad 31*c*.

Circuit components 134 to 139 and 141 are a circuit configuration for transmitting print data to the recording head 7*a*. The print data is transmitted to a logic block 144 in the recording head 7*a* via a filter formed of a resistor 138 and a capacitor 139. The recording head 7*a* discharges ink based on the print data received in this way. A GPIO terminal 136 connects between an ASIC 142 and the circuit 141 and operates in the input and output states. The input and output states are as described above in the first exemplary embodiment. The ASIC 142 includes a pull-down resistor 137. The pull-down resistor 137 connects with the GPIO terminal 136 when the GPIO terminal 136 is in the input state. FIG. 13A illustrates the circuit configuration when the GPIO terminal 136 is in the input state.

When the first attachment portion is in the first attachment state, a constant current source 132 in the circuit 131 supplies current to the diode temperature sensor 143 in the circuit in the recording head 7*a*. With this configuration, the diode temperature sensor 143 outputs the voltage Vf based on the temperature of the recording head 7*a*.

Since the voltage Vf has a minute value, the diode temperature sensor 143 outputs the voltage Vf to an amplifier 133 to amplify the voltage Vf. Thus, the amplifier 133 outputs the voltage Vfa having the amplified value of the voltage Vf. According to the present exemplary embodiment, the amplifier 133 has characteristics GAIN=$\alpha$ and offset=$\beta$ and therefore provides a specific value $\alpha Vf+\beta$ of the voltage Vfa. Then, the amplifier 133 outputs the voltage Vfa to the converter included in the ASIC 142. The ASIC 142 performs AD conversion on the voltage Vfa by using the converter and outputs a digital value based on the voltage Vf. According to the present exemplary embodiment, the 10-bit converter performs the AD conversion with a reference voltage Vref (=3.3 V) and therefore the specific digital value becomes $1024(\alpha Vf+\beta)/3.3$. Then, the ASIC 142 outputs the digital value obtained in this way to the CPU 154. Thus, when the attachment portion is in the first attachment state, the CPU 154 acquires a digital value based on the voltage Vf acquired from the diode temperature sensor 143 via the circuit 140. Then, the CPU 154 identifies that the first attachment portion is in the first attachment state based on the acquisition of a digital value within a specific range. In this case, since the temperature of the recording head 7*b* is close to the room temperature, the CPU 154 identifies that the attachment portion is in the first attachment state based on the acquisition of the digital value corresponding to the temperature close to the room temperature. State determination processing related to the first attachment portion performed using the digital value based on the voltage value acquired via the circuit 140 is hereinafter referred to as third determination processing.

Figure 13B:
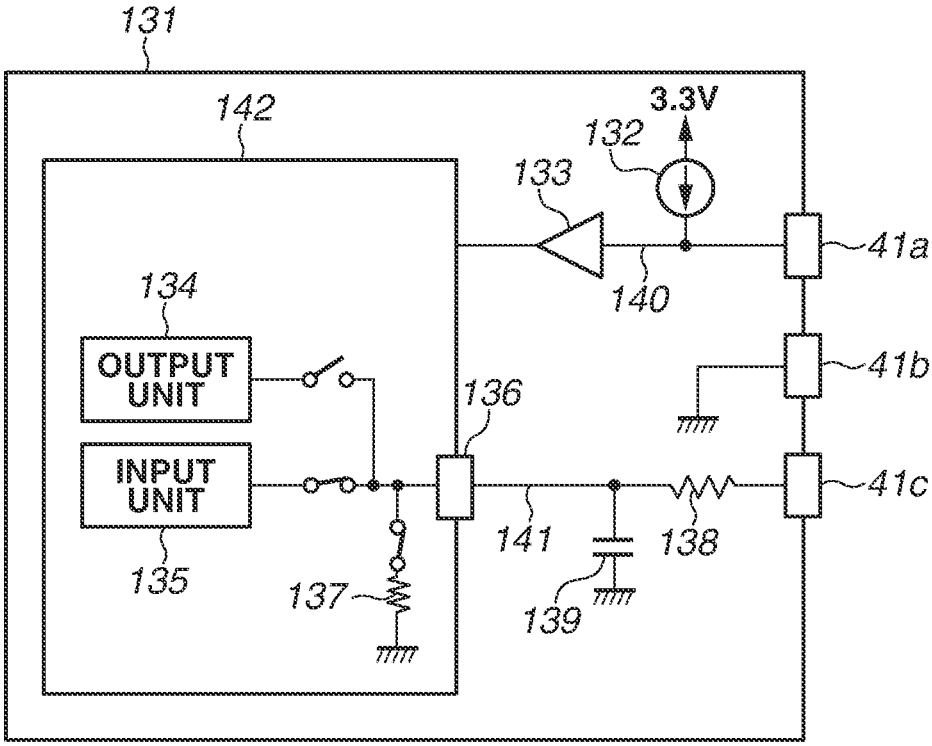

FIG. 13B illustrates a circuit configuration when the first attachment portion is in the third attachment state. When the first attachment portion is in the third attachment state, the circuit 141 on the main substrate becomes a high-impedance state since the circuit 141 does not electrically connect with other circuits. In the high-impedance state, no current flows even if the constant current source 132 tries to flow current. A voltage of 3.3 V to be used by the constant current source 132 to supply current is output to the amplifier 133 via the circuit 140. As a result, when the first attachment portion is in the third attachment state, the digital value corresponding to 3.3 V is acquired by the CPU 154. As described above, the contact protector 50 is not attached to the first attachment portion and therefore the first attachment portion does not enter the second attachment state. Thus, the CPU 154 identifies that the first attachment portion is in the third attachment state based on the acquisition of the digital value corresponding to 3.3 V.

According to the present exemplary embodiment, the third determination processing is performed in a state where the GPIO terminal 136 is set in the input state. However, the present invention is not limited thereto, and the third determination processing may be performed in a state where the GPIO terminal 136 is set in the output state.

In the above-described examples, the circuit 61 configured to obtain an output via the first attachment portion and transmit an output via the first attachment portion, and the circuit 131 configured to obtain an output via the second attachment portion and transmit an output via the second attachment portion, are separate configurations. However, the present invention is not limited thereto. The components included in the circuits 61 and 131 may be identical in part or whole.

Figure 14:
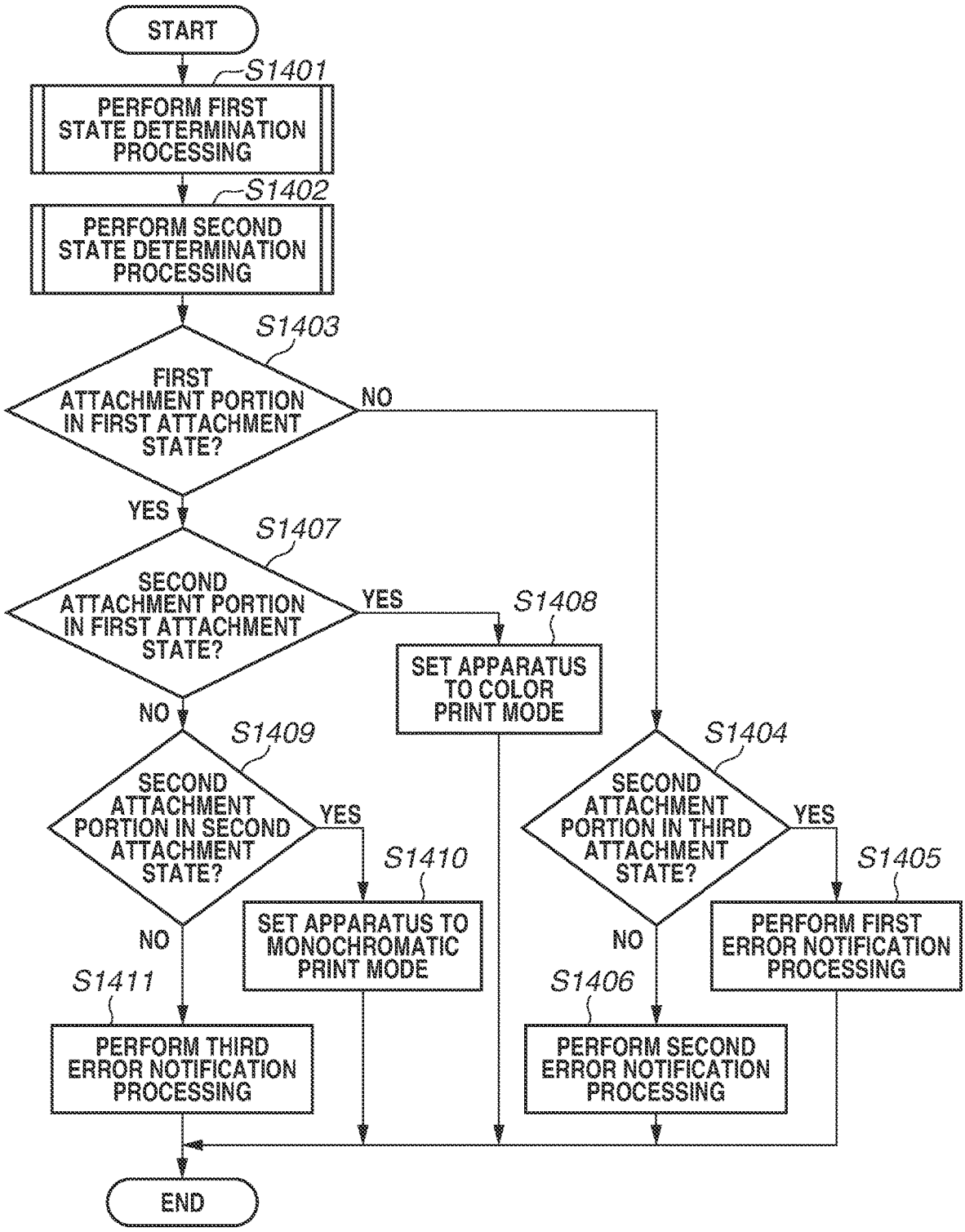
FIG. 14 is a flowchart illustrating state determination processing and processing based on the state determination processing.

FIG. 14 is a flowchart illustrating state determination processing performed by the recording apparatus 1 and processing based on the result of the state determination processing. For example, the processing indicated by the flowchart is implemented when the CPU 154 loads a program stored in the ROM 152 into the RAM 153 and then executes the program. The processing indicated by the flowchart is started when power of the recording apparatus 1 is turned on or when the recording head attached to the recording apparatus 1 is replaced. The CPU 154 detects whether the recording head attached to the recording apparatus 1 is replaced, for example, by detecting whether the cover for replacing the recording head included in the housing of the recording apparatus 1 is opened or closed. The processing indicated by the flowchart is started in a state where the GPIO terminal 136 is set in the input state.

In step S1401, the CPU 154 performs the first state determination processing (described in detail below).

In step S1402, the CPU 154 performs the second state determination processing. Details of the second state determination processing is as described above in the first exemplary embodiment with reference to FIG. 10.

In step S1403, the CPU 154 determines whether the attachment state of the first attachment portion identified by the first state determination processing in step S1401 is the first attachment state (or the third attachment state). When the attachment state of the first attachment portion is the first attachment state (YES in step S1403), the processing proceeds to step S1407. On the other hand, when the attachment state of the first attachment portion is not the first attachment state (NO in step S1403), the processing proceeds to step S1404.

In step S1404, the CPU 154 determines whether the attachment state of the second attachment portion identified by the second state determination processing in step S1402 is the third attachment state. When the attachment state of the second attachment portion is the third attachment state (YES in step S1404), the processing proceeds to step S1405. On the other hand, when the attachment state of the second attachment portion is not the third attachment state (NO in step S1404), the processing proceeds to S1406.

In step S1405, the CPU 154 performs first error notification processing for notifying the user of the occurrence of an error in which none of the attachment members is attached to the first and the second attachment portions (hereinafter this error is referred to as a first attachment error). More specifically, for example, the CPU 154 displays a first error notification screen for notifying the user of the occurrence of the first attachment error on the display unit (not illustrated) included in the recording apparatus 1. For example, the CPU 154 transmits first error notification information for notifying the user of the occurrence of the first attachment error to the information processing apparatus 101 connecting with the recording apparatus 1. With this operation, the information processing apparatus 101 displays the first error notification screen on the display unit 108. The information processing apparatus 101 enters a state of being unable to transmit a print job for executing color printing or a print job for executing monochrome printing to the recording apparatus 1. Like the first exemplary embodiment, the recording apparatus 1 is unable to perform color printing or monochrome printing in a state where an attachment error occurs. In this case, the information processing apparatus 101 may perform notification processing for prompting the user to attach the recording head 7*a* to the first attachment portion and attach the recording head 7*b* or the contact protector 50 to the second attachment portion. Then, the CPU 154 ends the processing of this flowchart.

In step S1406, the CPU 154 performs second error notification processing for notifying the user of the occurrence of an error in which the recording head 7*a* is not attached to the first attachment portion attached (hereinafter this error is referred to as a second attachment error). More specifically, for example, the CPU 154 displays a second error notification screen for notifying the user of the occurrence of the second attachment error on the display unit (not illustrated) included in the recording apparatus 1. For example, the CPU 154 transmits second error notification information for notifying the user of the occurrence of the second attachment error to the information processing apparatus 101 connecting with the recording apparatus 1. With this operation, the information processing apparatus 101 displays the second error notification screen on the display unit 108. The information processing apparatus 101 enters a state of being unable to transmit a print job for executing color printing or a print job for executing monochrome printing, to the recording apparatus 1. In this case, the information processing apparatus 101 may perform notification processing for prompting the user to attach the recording head 7*a* to the first attachment portion. Then, the CPU 154 ends the processing of this flowchart.

In step S1407, the CPU 154 determines whether the attachment state of the second attachment portion identified by the second state determination processing in step S1402 is the first attachment state. When the attachment state of the second attachment portion is the first attachment state (YES in step S1407), the processing proceeds to step S1408. On the other hand, when the attachment state of the second attachment portion is not the first attachment state (NO in step S1407), the processing proceeds to step S1409.

In step S1408, the CPU 154 operates the recording apparatus 1 in the color print mode. Details of the color print mode are as described above in the first exemplary embodiment. Then, the CPU 154 ends the processing of this flowchart.

In step S1409, the CPU 154 determines whether the attachment state of the second attachment portion identified by the second state determination processing in step S1402 is the second attachment state. When the attachment state of the second attachment portion is the second attachment state (YES in step S1409), the processing proceeds to step S1410. On the other hand, when the attachment state of the second attachment portion is not the second attachment state (NO in step S1409), the processing proceeds to step S1411.

In step S1410, the CPU 154 operates the recording apparatus 1 in the monochromatic print mode. Details of the monochromatic print mode are as described above in the first exemplary embodiment. Then, the CPU 154 ends the processing of this flowchart.

In step S1411, the CPU 154 performs third error notification processing. The third error notification processing is performed to notify the user of the occurrence of an error in which none of the recording head 7*b* and the contact protector 50 is attached to the second attachment portion (hereinafter this error is referred to as a third attachment error). More specifically, for example, the CPU 154 displays a third error notification screen for notifying the user of the occurrence of the third attachment error on the display unit (not illustrated) included in the recording apparatus 1. For example, the CPU 154 transmits third error notification information for notifying the user of the occurrence of the third attachment error to the information processing apparatus 101 connecting with the recording apparatus 1. With this operation, the information processing apparatus 101 displays the third error notification screen on the display unit 108. The information processing apparatus 101 enters a state of being unable to transmit a print job for executing color printing or a print job for executing monochrome printing to the recording apparatus 1. In this case, the information processing apparatus 101 may perform notification processing for prompting the user to attach the recording head 7*b* or the contact protector 50 to the second attachment portion. Then, the CPU 154 ends the processing of this flowchart.

The present invention is not limited to the above-described configuration. For example, when the CPU 154 identifies that the first attachment portion is in the third attachment state through the first state determination processing, the CPU 154 may perform the error notification processing without performing the second state determination processing.

Although, in the above-described configuration, the processing contents (including the contents of the error notification screen and the contents of the error notification information) differ for each piece of error notification processing, the processing contents may be identical. For example, the CPU 154 may perform, in each piece of error notification processing, processing for notifying the user of the occurrence of an error in which none of the attachment members is attached to at least one attachment portion. In this case, the error notification screen and the error notification information are identical for each piece of error notification processing.

Figure 15:
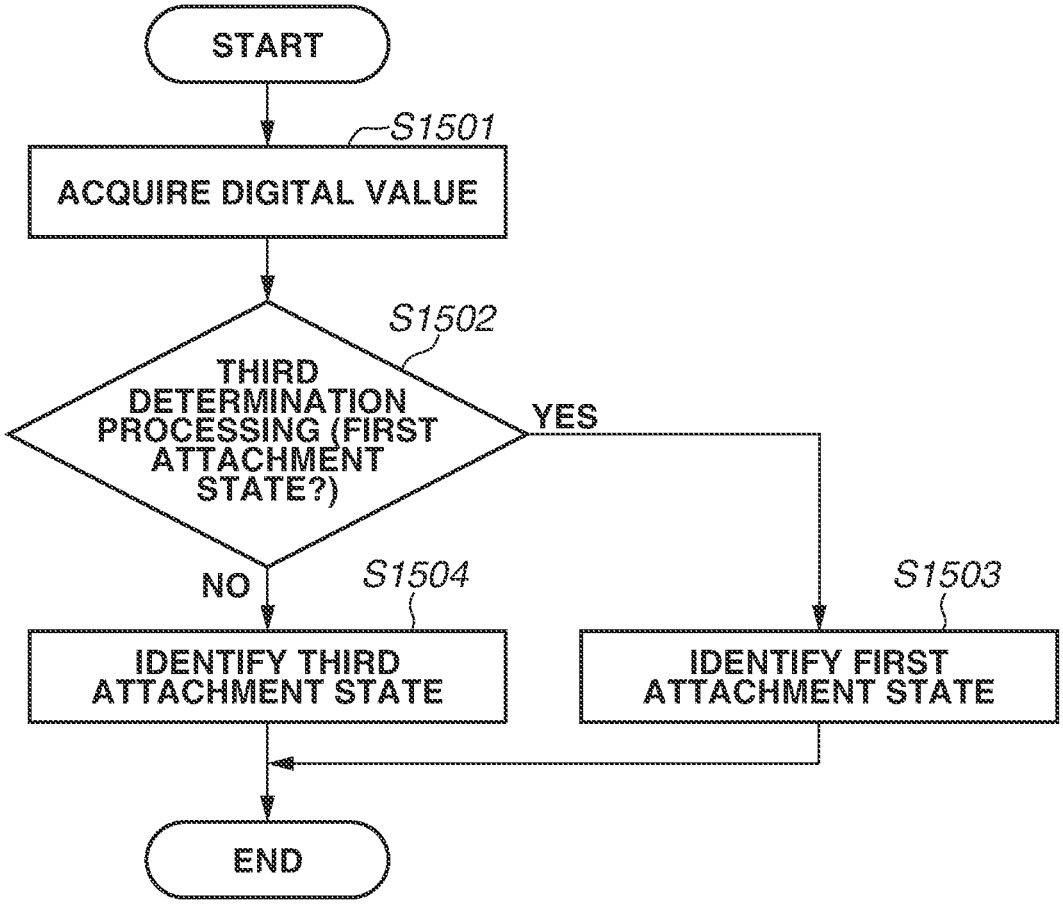
FIG. 15 is flowchart illustrating details of state determination processing.

FIG. 15 is flowchart illustrating details of the first state determination processing performed in step S1401 by the recording apparatus 1. For example, the processing indicated by the flowchart is implemented when the CPU 154 loads a program stored in the ROM 152 into the RAM 153 and then executes the program.

In step S1501, in a state where the GPIO terminal 136 is set in the input state, the CPU 154 starts supplying current by the constant current source 132 and acquires the digital value corresponding to the output via the circuit 140. The method for acquiring the digital value is as described above.

In step S1502, the CPU 154 performs the third determination processing. More specifically, the CPU 154 determines whether the attachment portion is in the first attachment state based on the digital value acquired in step S1501 and the threshold value illustrated in FIG. 9. When the attachment portion is in the first attachment state (YES in step S1502), the processing proceeds to step S1503. On the other hand, when the attachment portion is not in the first attachment state (NO in step S1502), the processing proceeds to step S1504.

In step S1503, the CPU 154 identifies that the first attachment portion is in the first attachment state. This identification result is referenced in the processing in the flowchart illustrated in FIG. 14, as described above. Then, the CPU 154 ends the processing of this flowchart, and the processing proceeds to step S1402.

In step S1504, the CPU 154 identifies that the first attachment portion is in the third attachment state. This identification result is referenced in the processing of the flowchart illustrated in FIG. 14 as described above. Then, the CPU 154 ends the processing of this flowchart, and the processing proceeds to step S1402.

The above-described configuration enables the recording apparatus 1 to perform processing suitable for each attachment portion.

Other Embodiments

Although, in the above-described exemplary embodiments, black ink is supplied from the ink tank 9 outside the recording head 7*a* and non-black ink (color ink) is prestored in the recording head 7*b*, the present invention is not limited thereto. Non-black ink (color ink) may also be supplied from an ink tank outside the recording head 7*b*.

Although, in the above-described exemplary embodiments, ink of a plurality of colors is stored in the recording head 7*b*, the present invention is not limited thereto. Ink of one color may be stored in one recording head.

Although, in the above-described exemplary embodiments, the recording head 7*b* is attachable to and detachable from the attachment portion, the present invention is not limited thereto. For example, instead of the recording head 7*b* itself, an ink cartridge for supplying color ink to the recording head 7*b* may be attachable to and detachable from the recording head 7*b*. If the recording apparatus 1 is not an ink jet printer but an electrophotographic printer, for example, a toner cartridge for supplying toner as a recording material may be attachable to and detachable from the attachment portion.

Although, in the above-described exemplary embodiments, two recording heads can be attached to the recording apparatus 1, the present invention is not limited thereto. Only one recording head may be attachable to the recording apparatus 1, or three or more recording heads may be attachable thereto. In this case, the above-described state determination processing and processing according to the result thereof may be performed for each attachment portion.

In the above-described exemplary embodiment, the state determination processing by using the configuration for obtaining the output from the diode temperature sensor 143, the present invention is not limited thereto. For example, the CPU 154 may make an attempt to acquire identification IDs included in the recording heads and contact pad, and perform the state determination processing based on whether the acquisition of the identification IDs is successful and the contents of the acquired identification IDs. In addition, for example, the CPU 154 may perform the state determination processing based on the output of a physical sensor, provided on the recording apparatus 1, for detecting attachment members attached to the attachment portions. More specifically, according to the present invention, the method for the state determination processing is not limited to a certain method, processing according to the result of the state determination processing only needs to be performed.

Although, in the above-described exemplary embodiments, the CPU 154 sets the color print mode, sets the monochromatic print mode, and performs notification processing as processing according to the determination result, the present invention is not limited thereto. Different processing only needs to be performed according to the determination result. For example, screen display may be controlled so as to display different screens according to the determination result. More specifically, when the attachment portion is identified to be in the first attachment state, a screen indicating that the attachment portion is in the first attachment state may be displayed. When the attachment portion is identified to be in the second attachment state, a screen indicating that the attachment portion is in the second attachment state may be displayed. When the attachment portion is identified to be in the third attachment state, a screen indicating that the attachment portion is in the third attachment state may be displayed.

The present invention can also be achieved when a program for implementing at least one of the functions according to the above-described exemplary embodiments is supplied to a system or apparatus via a network or storage medium, and at least one processor in a computer of the system or apparatus reads and executes the program. Further, the present invention can also be achieved by a circuit (e.g., an ASIC) for implementing at least one function.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-072547, filed Apr. 5, 2019, which is hereby incorporated by reference herein in its entirety.

What is claimed is:

1. A recording apparatus capable of operating in a first print mode, in which first print processing using at least a recording material of a first color and a recording material of a second color can be performed, and a second print mode, in which second print processing using the recording material of the first color and not using the recording material of the second color can be performed, and including an attachment portion to which a first attachment member having a storage unit for storing the recording material of the second color or a second attachment member not having the storage unit is attachable, and further including another attachment portion different from the attachment portion, and to which a third attachment member having a storage unit for storing the recording material of the first color is attachable, the recording apparatus comprising:

an acquisition unit configured to acquire predetermined information via a predetermined component included in the recording apparatus to acquire information based on a temperature of the first attachment member in a case where the first attachment member is attached to the attachment portion, wherein, in a case where the first attachment member is attached to the attachment portion, the information based on the temperature of the first attachment member is acquired as the predetermined information;

a determination unit configured to perform determination processing for determining whether the first attachment member is attached to the attachment portion or the second attachment member is attached to the attachment portion based on the acquired predetermined information; and a control unit configured to operate the recording apparatus in the first print mode in a case where the determination unit determines that the first attachment member is attached to the attachment portion, and operate the recording apparatus in the second print mode in a case where the determination unit determines that the second attachment member is attached to the attachment portion;

wherein, in a case where the third attachment member is attached to the other attachment portion and the first attachment member is attached to the attachment portion, the recording apparatus is operated in the first print mode, and wherein, in a case where the third attachment member is attached to the other attachment portion and the second attachment member is attached to the attachment portion, the recording apparatus is operated in the second print mode.

2. The recording apparatus according to claim 1, further comprising a notification unit configured to, in a case where neither of the first nor the second attachment members is attached to the attachment portion, perform notification processing for issuing a notification to a user.

3. The recording apparatus according to claim 2, wherein the notification processing is at least one of processing for displaying a notification screen for issuing a notification to the user on a display unit, and processing for transmitting notification information for issuing a notification to the user to an information processing apparatus connected to the recording apparatus.

4. The recording apparatus according to claim 2, wherein the notification processing is at least one of processing for notifying the user that none of the first and the second attachment members is attached to the attachment portion, and processing for prompting the user to attach the first attachment member or the second attachment member to the attachment portion.

5. The recording apparatus according to claim 1, further comprising a notification unit configured to perform processing for issuing a notification to the user in a case where the third attachment member is not attached to the other attachment portion.

6. The recording apparatus according to claim 1, wherein, in a case where neither of the first and the second attachment members is attached to the attachment portion, the recording apparatus is operated in a third print mode in which neither of the first and the second print processing is performed.

7. The recording apparatus according to claim 1, wherein the first attachment member includes a predetermined sensor for outputting a voltage value based on a temperature of the first attachment member, wherein the predetermined component is a first circuit for obtaining a voltage value output from the predetermined sensor in a case where the first attachment member is attached to the attachment portion, wherein the predetermined information is a predetermined output based on the voltage value acquired via the first circuit, and wherein, in a case where the attachment portion is attached with the first attachment member, the predetermined output is an output based on the voltage value output from the predetermined sensor.

8. The recording apparatus according to claim 7, further comprising a second circuit for outputting a signal to the first attachment member in a case where the first attachment member is attached to the attachment portion, wherein the second attachment member includes a short circuit for short-circuiting the first and the second circuits, and wherein, in a case where the second attachment member is attached to the attachment portion, the predetermined output is an output based on the voltage value acquired via the first circuit in a state where the first and the second circuits are short-circuited by the short circuit.

9. The recording apparatus according to claim 8, wherein the determination processing includes first determination processing for determining whether the first attachment member is attached to the attachment portion, and second determination processing for determining whether the second attachment member is attached to the attachment portion, the second determination processing being performed in a case where the first determination processing determines that the first attachment member is not attached to the attachment portion, wherein the second circuit is in one of an output state where the signal can be output to a member attached to the attachment portion and an input state where the signal is not output to the member attached to the attachment portion, wherein the first determination processing is performed based on the predetermined output based on the voltage value acquired via the first circuit in a state where the second circuit is in the input state, and wherein the second determination processing is performed based on the predetermined output based on the voltage value acquired via the first circuit in a state where the second circuit is in the output state.

10. The recording apparatus according to claim 8, wherein the second circuit is in one of an output state where the signal can be output to a member attached to the attachment portion and an input state where the signal is not output to the member attached to the attachment portion, and wherein the determination processing is performed based on the predetermined output based on the voltage value acquired via the first circuit in a state where the second circuit is in the output state.

11. The recording apparatus according to claim 7, wherein the determination processing is performed to determine whether the first attachment member is attached to the attachment portion, the second attachment member is attached to the attachment portion, or neither of the first and the second attachment members is attached to the attachment portion, wherein, in a case where neither of the first and the second attachment members is attached to the attachment portion, the first circuit becomes a high-impedance state, and wherein, in a case where none of the first and the second attachment members is attached to the attachment portion, the predetermined output is an output based on the voltage value acquired via the first circuit in the high-impedance state.

12. The recording apparatus according to claim 7, wherein the predetermined output is a value obtained through analog to digital conversion on the voltage value acquired via the first circuit.

13. The recording apparatus according to claim 1, further comprising a transmission unit configured to, in a case where the recording apparatus operates in the second print mode, transmit information for operating an information processing apparatus connected to the recording apparatus in a state where a print job for instructing the recording apparatus to execute the first print processing is not transmitted to the information processing apparatus.

14. The recording apparatus according to claim 1, wherein the first attachment member is a recording head for discharging the recording material of the second color or a cartridge for storing the recording material of the second color.

15. The recording apparatus according to claim 1, wherein the recording material of the first color is a black recording material, and the recording material of the second color is a non-black recording material.

16. The recording apparatus according to claim 1, wherein the second attachment member is a protection member for protecting a connection terminal of the attachment portion.

17. The recording apparatus according to claim 1, further comprising:

an error determination unit configured to, in a case where the first attachment member is attached to the attachment portion, determine, based on the predetermined information, whether an error related to the temperature of the first attachment member has occurred; and a notification unit configured to, in a case where an error related to the temperature of the first attachment member is determined to have occurred, perform processing for issuing a notification about the occurrence of the error related to the temperature of the first attachment member.

18. A method for controlling a recording apparatus capable of operating in a first print mode, in which first print processing using at least a recording material of a first color and a recording material of a second color can be performed, and a second print mode, in which second print processing using the recording material of the first color and not using the recording material of the second color can be performed, and including an attachment portion to which a first attachment member having a storage unit for storing the recording material of the second color or a second attachment member not having the storage unit is attachable, and further including another attachment portion different from the attachment portion, and to which a third attachment member having a storage unit for storing the recording material of the first color is attachable, the method comprising:

acquiring predetermined information via a predetermined component included in the recording apparatus to acquire information based on a temperature of the first attachment member in a case where the first attachment member is attached to the attachment portion, wherein, in a case where the first attachment member is attached to the attachment portion, the information based on the temperature of the first attachment member is acquired as the predetermined information;

performing determination processing for determining whether the first attachment member is attached to the attachment portion or the second attachment member is attached to the attachment portion based on the acquired predetermined information; and operating the recording apparatus in the first print mode in a case where it is determined that the first attachment member is attached to the attachment portion, and operate the recording apparatus in the second print mode in a case where it is determined that the second attachment member is attached to the attachment portion, wherein, in a case where the third attachment member is attached to the other attachment portion and the first attachment member is attached to the attachment portion, the recording apparatus is operated in the first print mode, and wherein, in a case where the third attachment member is attached to the other attachment portion and the second attachment member is attached to the attachment portion, the recording apparatus is operated in the second print mode.

19. A recording apparatus capable of operating in a first print mode, in which first print processing using at least a recording material of a first color and a recording material of a second color can be performed, and a second print mode, in which second print processing using the recording material of the first color and not using the recording material of the second color can be performed, and including an attachment portion to which a first attachment member having a storage unit for storing the recording material of the second color or a second attachment member not having the storage unit is attachable, the recording apparatus comprising:

an acquisition unit configured to acquire predetermined information via a predetermined component included in the recording apparatus to acquire information based on a temperature of the first attachment member in a case where the first attachment member is attached to the attachment portion, wherein, in a case where the first attachment member is attached to the attachment portion, the information based on the temperature of the first attachment member is acquired as the predetermined information;

a determination unit configured to perform determination processing for determining whether the first attachment member is attached to the attachment portion or the second attachment member is attached to the attachment portion based on the acquired predetermined information; and a control unit configured to operate the recording apparatus in the first print mode in a case where the determination unit determines that the first attachment member is attached to the attachment portion, and operate the recording apparatus in the second print mode in a case where the determination unit determines that the second attachment member is attached to the attachment portion;

wherein the first attachment member includes a predetermined sensor for outputting a voltage value based on a temperature of the first attachment member, wherein the predetermined component is a first circuit for obtaining a voltage value output from the predetermined sensor in a case where the first attachment member is attached to the attachment portion, wherein the predetermined information is a predetermined output based on the voltage value acquired via the first circuit, wherein, in a case where the attachment portion is attached with the first attachment member, the predetermined output is an output based on the voltage value output from the predetermined sensor, wherein the recording apparatus further comprises a second circuit for outputting a signal to the first attachment member in a case where the first attachment member is attached to the attachment portion, wherein the second attachment member includes a short circuit for short-circuiting the first and the second circuits, and wherein, in a case where the second attachment member is attached to the attachment portion, the predetermined output is an output based on the voltage value acquired via the first circuit in a state where the first and the second circuits are short-circuited by the short circuit.

* * * * *